US011667416B2

(12) United States Patent
Lancaster, III et al.

(10) Patent No.: US 11,667,416 B2
(45) Date of Patent: Jun. 6, 2023

(54) LOAD WRAPPING APPARATUS WRAP PROFILES WITH CONTROLLED WRAP CYCLE INTERRUPTIONS

(71) Applicant: Lantech.com, LLC, Louisville, KY (US)

(72) Inventors: Patrick R. Lancaster, III, Louisville, KY (US); Daniel R. Hendren, Mount Washington, KY (US); Jim Lancaster, Louisville, KY (US); Michael P. Mitchell, Louisville, KY (US); Robert D. Janes, Sr., Louisville, KY (US)

(73) Assignee: Lantech.com, LLC, Louisville, KY (US)

( * ) Notice: Subject to any disclaimer, the term of this patent is extended or adjusted under 35 U.S.C. 154(b) by 168 days.

(21) Appl. No.: 16/648,531

(22) PCT Filed: Sep. 21, 2018

(86) PCT No.: PCT/IB2018/057341

§ 371 (c)(1),
(2) Date: Mar. 18, 2020

(87) PCT Pub. No.: WO2019/058335

PCT Pub. Date: Mar. 28, 2019

(65) Prior Publication Data

US 2020/0283176 A1 Sep. 10, 2020

Related U.S. Application Data

(60) Provisional application No. 62/562,096, filed on Sep. 22, 2017.

(51) Int. Cl.
*B65B 11/02* (2006.01)
*B65B 41/16* (2006.01)
(Continued)

(52) U.S. Cl.
CPC ..... *B65B 11/025* (2013.01); *B65B 41/16* (2013.01); *B65B 57/04* (2013.01); *B65B 57/12* (2013.01);
(Continued)

(58) Field of Classification Search
None
See application file for complete search history.

(56) References Cited

U.S. PATENT DOCUMENTS 2,076,617 A 4/1937 Cleaves
2,227,398 A 12/1940 Mohl
(Continued)

FOREIGN PATENT DOCUMENTS

CA 2277316 1/2001
CA 3076451 5/2021
(Continued)

OTHER PUBLICATIONS

European Patent Office; Communication in Application No. 18857679.7 dated Jan. 31, 2022 (LANT-424EP).
(Continued)

*Primary Examiner* — Nathaniel C Chukwurah
*Assistant Examiner* — Tanzim Imam
(74) *Attorney, Agent, or Firm* — Gray Ice Higdon

(57) ABSTRACT

A method, apparatus and program product are provided that utilize wrap profiles that specify controlled wrap cycle interruptions to handle specialized load requirements for loads to be wrapped by a stretch wrapping machine. Also provided is a method of creating wrap profiles, and a plurality of wrap profiles are stored in a database.

28 Claims, 16 Drawing Sheets

(51) Int. Cl.

| | |
|---|---|
| ***B65B 57/04*** | (2006.01) |
| ***B65B 57/12*** | (2006.01) |
| ***B65B 57/18*** | (2006.01) |
| *B65B 11/00* | (2006.01) |

(52) U.S. Cl.

CPC ..... *B65B 57/18* (2013.01); *B65B 2011/002* (2013.01)

(56) References Cited

U.S. PATENT DOCUMENTS

| | | | |
|---|---|---|---|
| 2,904,196 | A | 9/1959 | Teixeira |
| 3,029,571 | A | 4/1962 | Douthit |
| 3,707,658 | A | 12/1972 | Hilsenbeck |
| 3,776,081 | A | 12/1973 | Becker |
| 3,815,313 | A | 6/1974 | Heisler |
| 3,867,806 | A | 2/1975 | Lancaster, III |
| 3,910,005 | A | 10/1975 | Thimon et al. |
| 4,077,179 | A | 3/1978 | Lancaster et al. |
| 4,079,566 | A | 3/1978 | Stoecklin |
| 4,152,879 | A | 5/1979 | Shulman |
| 4,216,640 | A | 8/1980 | Kaufman |
| 4,235,062 | A | 11/1980 | Lancaster, III et al. |
| 4,271,657 | A | 6/1981 | Lancaster, III et al. |
| 4,300,326 | A | 11/1981 | Stackhouse |
| 4,387,548 | A | 6/1983 | Lancaster et al. |
| 4,395,255 | A | 7/1983 | Branecky et al. |
| 4,418,510 | A | 12/1983 | Lancaster, III et al. |
| 4,429,514 | A | 2/1984 | Lancaster et al. |
| 4,432,185 | A | 2/1984 | Geisinger |
| 4,458,467 | A | 7/1984 | Shulman et al. |
| 4,497,159 | A | 2/1985 | Lancaster, III |
| 4,501,105 | A | 2/1985 | Rogers et al. |
| 4,503,658 | A | 3/1985 | Mouser et al. |
| 4,505,092 | A | 3/1985 | Bowers et al. |
| 4,514,955 | A | 5/1985 | Mouser et al. |
| 4,524,568 | A | 6/1985 | Lancaster et al. |
| 4,545,182 | A | 10/1985 | McDowell, Jr. |
| 4,590,746 | A | 5/1986 | Humphrey |
| 4,628,667 | A | 12/1986 | Humphrey et al. |
| 4,631,898 | A | 12/1986 | Brambilla |
| 4,676,048 | A | 6/1987 | Lancaster et al. |
| 4,693,049 | A | 9/1987 | Humphrey |
| 4,712,354 | A | 12/1987 | Lancaster et al. |
| 4,736,567 | A | 4/1988 | Pienta |
| 4,754,594 | A | 7/1988 | Lancaster |
| 4,761,934 | A | 8/1988 | Lancaster |
| 4,807,427 | A | 2/1989 | Casteel et al. |
| 4,840,006 | A | 6/1989 | Humphrey |
| 4,845,920 | A | 7/1989 | Lancaster |
| 4,852,330 | A | 8/1989 | Carangelo |
| 4,862,678 | A | 9/1989 | Humphrey |
| 4,866,909 | A | 9/1989 | Lancaster, III et al. |
| 4,905,451 | A | 3/1990 | Jaconelli et al. |
| 4,938,008 | A | 7/1990 | Salzsauer |
| 4,953,336 | A | 9/1990 | Lancaster, III et al. |
| 4,955,176 | A | 9/1990 | Seko et al. |
| 4,991,381 | A | 2/1991 | Simons |
| 5,027,579 | A | 7/1991 | Keip |
| 5,040,356 | A | 8/1991 | Thimon |
| 5,040,359 | A | 8/1991 | Thimon |
| 5,054,263 | A | 10/1991 | Maki-Rahkola et al. |
| 5,054,987 | A | 10/1991 | Thornton |
| 5,077,956 | A | 1/1992 | Thimon |
| 5,081,824 | A | 1/1992 | Thimon et al. |
| 5,107,657 | A | 4/1992 | Diehl et al. |
| 5,123,230 | A | 6/1992 | Upmann |
| 5,138,817 | A | 8/1992 | Mowry et al. |
| 5,163,264 | A | 11/1992 | Hannen |
| 5,186,981 | A | 2/1993 | Shellhamer et al. |
| 5,195,296 | A | 3/1993 | Matsumoto |
| 5,195,297 | A | 3/1993 | Lancaster et al. |
| 5,195,301 | A | 3/1993 | Martin-Cocher et al. |
| 5,203,136 | A | 4/1993 | Thimon et al. |
| 5,203,139 | A | 4/1993 | Salsburg et al. |
| 5,203,671 | A | 4/1993 | Cawley et al. |
| 5,216,871 | A | 6/1993 | Hannen |
| 5,240,198 | A | 8/1993 | Dorfel |
| 5,301,493 | A | 4/1994 | Chen |
| 5,311,725 | A | 5/1994 | Martin et al. |
| 5,315,809 | A | 5/1994 | Gordon et al. |
| 5,351,461 | A | 10/1994 | Fandard et al. |
| 5,369,416 | A | 11/1994 | Haverty et al. |
| 5,414,979 | A | 5/1995 | Moore et al. |
| 5,447,008 | A | 9/1995 | Martin-Cocher |
| 5,450,711 | A | 9/1995 | Martin-Cocher |
| 5,463,842 | A | 11/1995 | Lancaster |
| 5,524,413 | A | 6/1996 | Fukuda |
| 5,546,730 | A | 8/1996 | Newell et al. |
| 5,572,855 | A | 11/1996 | Reigrut et al. |
| 5,581,979 | A | 12/1996 | Scherer |
| 5,595,042 | A | 1/1997 | Cappi et al. |
| 5,610,344 | A | 3/1997 | Ueda et al. |
| 5,634,321 | A | 6/1997 | Martin-Cocher et al. |
| 5,653,093 | A | 8/1997 | Delledonne |
| 5,671,593 | A | 9/1997 | Ginestra et al. |
| 5,765,344 | A | 6/1998 | Mandeville et al. |
| 5,768,862 | A | 6/1998 | Mauro et al. |
| 5,794,416 | A | 8/1998 | Rahman |
| 5,799,471 | A | 9/1998 | Chen |
| 5,836,140 | A | 11/1998 | Lancaster, III |
| 5,875,617 | A | 3/1999 | Scherer |
| 5,884,453 | A | 3/1999 | Ramsey et al. |
| 5,885,453 | A | 3/1999 | Chatelin et al. |
| 5,893,258 | A | 4/1999 | Lancaster et al. |
| 5,941,049 | A | 8/1999 | Lancaster et al. |
| 5,953,888 | A | 9/1999 | Martin-Cocher et al. |
| 6,082,081 | A | 7/2000 | Mucha |
| 6,170,228 | B1 | 1/2001 | Zeman |
| 6,170,233 | B1 | 1/2001 | Marois et al. |
| 6,195,968 | B1 | 3/2001 | Marois et al. |
| 6,253,532 | B1 | 7/2001 | Orpen |
| 6,293,074 | B1 | 9/2001 | Lancaster, III et al. |
| 6,314,333 | B1 | 11/2001 | Rajala et al. |
| 6,360,512 | B1 | 3/2002 | Marois et al. |
| 6,370,839 | B1 * | 4/2002 | Nakagawa ..... B65B 11/045 53/64 |
| 6,453,643 | B1 | 9/2002 | Buscherini et al. |
| 6,516,591 | B1 | 2/2003 | Lancaster, III et al. |
| 6,598,379 | B2 | 7/2003 | Zitella |
| 6,684,612 | B2 | 2/2004 | Trottet |
| 6,698,161 | B1 | 3/2004 | Rossi |
| 6,748,718 | B2 | 6/2004 | Lancaster, III et al. |
| 6,826,893 | B2 | 12/2004 | Cere' |
| 6,848,240 | B2 | 2/2005 | Frey |
| 6,851,252 | B2 | 2/2005 | Maki-Rahkola et al. |
| 6,918,225 | B2 | 7/2005 | Ours et al. |
| 6,918,229 | B2 | 7/2005 | Lancaster, III et al. |
| 7,040,071 | B2 | 5/2006 | Heikaus |
| 7,114,308 | B2 | 10/2006 | Cox |
| 7,137,233 | B2 | 11/2006 | Degrasse et al. |
| 7,178,317 | B1 | 2/2007 | Koskela |
| 7,386,968 | B2 | 6/2008 | Sperry et al. |
| 7,540,128 | B2 | 6/2009 | Lancaster, III et al. |
| 7,568,327 | B2 | 8/2009 | Lancaster, III et al. |
| 7,707,801 | B2 | 5/2010 | Lancaster, III |
| 7,707,901 | B2 | 5/2010 | Lancaster, III et al. |
| 7,779,607 | B2 | 8/2010 | Lancaster, III et al. |
| 8,001,745 | B2 | 8/2011 | Carter et al. |
| 8,037,660 | B2 | 10/2011 | Lancaster, III et al. |
| 8,276,346 | B2 | 10/2012 | Lancaster, III et al. |
| 8,276,354 | B2 | 10/2012 | Lancaster, III et al. |
| 8,296,101 | B1 | 10/2012 | Barlow et al. |
| 8,424,271 | B2 | 4/2013 | Murarotto |
| 8,539,739 | B2 | 9/2013 | Pierson et al. |
| 8,549,819 | B1 | 10/2013 | Bison |
| 8,707,644 | B2 | 4/2014 | Degen et al. |
| 8,739,502 | B2 | 6/2014 | Lancaster, III |
| 8,772,651 | B2 | 7/2014 | Martin et al. |
| 10,676,292 | B2 | 6/2020 | Saylor |
| 2001/0015057 | A1 | 8/2001 | Suolahti |
| 2001/0017023 | A1 | 8/2001 | Armington et al. |
| 2002/0029540 | A1 | 3/2002 | Lancaster et al. |
| 2003/0089081 | A1 | 5/2003 | Platon |

(56) References Cited

U.S. PATENT DOCUMENTS

| | | | |
|---|---|---|---|
| 2003/0093973 | A1 | 5/2003 | Mir |
| 2003/0110737 | A1 | 6/2003 | Lancaster et al. |
| 2003/0145563 | A1 | 8/2003 | Cere' |
| 2003/0158684 | A1 | 8/2003 | Livingston |
| 2003/0200731 | A1 | 10/2003 | Maki-Rahkola et al. |
| 2003/0200732 | A1 | 10/2003 | Maki-Rahkola et al. |
| 2004/0031238 | A1 | 2/2004 | Cox |
| 2004/0040477 | A1 | 3/2004 | Neumann |
| 2004/0060264 | A1 | 4/2004 | Miller |
| 2004/0129150 | A1 | 7/2004 | Lancaster et al. |
| 2004/0177592 | A1 | 9/2004 | Lancaster et al. |
| 2004/0243277 | A1 | 12/2004 | Bonnain et al. |
| 2005/0044812 | A1 | 3/2005 | Lancaster et al. |
| 2005/0115202 | A1 | 6/2005 | Mertz et al. |
| 2005/0284783 | A1 | 12/2005 | May, Jr. |
| 2006/0028969 | A1 | 2/2006 | Kondo et al. |
| 2006/0213155 | A1 | 9/2006 | Forni et al. |
| 2006/0248858 | A1 | 11/2006 | Lancaster |
| 2006/0254225 | A1 | 11/2006 | Lancaster et al. |
| 2006/0289691 | A1 | 12/2006 | Forni |
| 2007/0169442 | A1 | 7/2007 | Asiold |
| 2007/0204564 | A1 | 9/2007 | Lancaster et al. |
| 2007/0204565 | A1 | 9/2007 | Lancaster et al. |
| 2007/0209324 | A1 | 9/2007 | Lancaster et al. |
| 2008/0066431 | A1 | 3/2008 | Cousins |
| 2008/0216449 | A1 | 9/2008 | Zimmerli |
| 2008/0229707 | A1 | 9/2008 | Zitella et al. |
| 2008/0229716 | A1* | 9/2008 | Zitella ..... B65B 11/025 53/461 |
| 2008/0295614 | A1 | 12/2008 | Lancaster, III et al. |
| 2008/0307754 | A1 | 12/2008 | Storig et al. |
| 2009/0178374 | A1 | 7/2009 | Lancaster, III et al. |
| 2009/0235617 | A1 | 9/2009 | Moore et al. |
| 2009/0277901 | A1 | 11/2009 | Port et al. |
| 2009/0293425 | A1 | 12/2009 | Carter et al. |
| 2009/0313942 | A1 | 12/2009 | Murarotto |
| 2010/0037562 | A1 | 2/2010 | Forni et al. |
| 2010/0107653 | A1 | 5/2010 | Paskevich et al. |
| 2010/0126119 | A1 | 5/2010 | Ours |
| 2010/0163443 | A1 | 7/2010 | Störig et al. |
| 2010/0239403 | A1 | 9/2010 | Lancaster, III et al. |
| 2010/0300049 | A1 | 12/2010 | Schmidt et al. |
| 2010/0303526 | A1 | 12/2010 | Hayase |
| 2010/0313525 | A1 | 12/2010 | Martin et al. |
| 2010/0320305 | A1 | 12/2010 | Lia |
| 2011/0131927 | A1 | 6/2011 | Lancaster, III et al. |
| 2011/0146203 | A1 | 6/2011 | Lancaster, III et al. |
| 2011/0168751 | A1 | 7/2011 | Tsurumi |
| 2011/0179752 | A1 | 7/2011 | Lancaster, III et al. |
| 2012/0031053 | A1 | 2/2012 | Lancaster, III et al. |
| 2012/0042615 | A1 | 2/2012 | Roche |
| 2012/0102886 | A1 | 5/2012 | Lancaster, III et al. |
| 2012/0102887 | A1 | 5/2012 | Lancaster, III et al. |
| 2012/0124944 | A1 | 5/2012 | Lancaster, III et al. |
| 2012/0181368 | A1 | 7/2012 | Ekola |
| 2013/0000252 | A1 | 1/2013 | Pettersson et al. |
| 2013/0061558 | A1 | 3/2013 | Klear et al. |
| 2013/0067865 | A1 | 3/2013 | Maruo |
| 2013/0076753 | A1 | 3/2013 | Lancaster, III et al. |
| 2013/0199133 | A1 | 8/2013 | Kluge et al. |
| 2013/0247519 | A1 | 9/2013 | Clark et al. |
| 2013/0326999 | A1 | 12/2013 | Lemieux et al. |
| 2014/0013707 | A1 | 1/2014 | Murarotto |
| 2014/0053502 | A1 | 2/2014 | Pecchenini |
| 2014/0109523 | A1 | 4/2014 | Nelson |
| 2014/0116006 | A1 | 5/2014 | Lancaster, III et al. |
| 2014/0116007 | A1 | 5/2014 | Lancaster, III et al. |
| 2014/0116008 | A1 | 5/2014 | Lancaster, III et al. |
| 2014/0123605 | A1 | 5/2014 | Cere' et al. |
| 2014/0168422 | A1 | 6/2014 | Feng et al. |
| 2014/0174036 | A1 | 6/2014 | Field |
| 2014/0208696 | A1 | 7/2014 | Phillips et al. |
| 2014/0223863 | A1* | 8/2014 | Lancaster, III ..... B65B 11/00 53/436 |
| 2014/0223864 | A1 | 8/2014 | Lancaster, III et al. |
| 2014/0331609 | A1 | 11/2014 | Bison |
| 2015/0096266 | A1 | 4/2015 | Divine et al. |
| 2015/0128530 | A1 | 5/2015 | Brunson et al. |
| 2015/0197360 | A1 | 7/2015 | Lancaster, III |
| 2015/0353220 | A1 | 12/2015 | Lancaster, III |
| 2016/0096645 | A1 | 4/2016 | Lancaster et al. |
| 2016/0096646 | A1 | 4/2016 | Lancaster et al. |
| 2016/0098171 | A1 | 4/2016 | Lancaster et al. |
| 2017/0052075 | A1 | 2/2017 | Cere' |
| 2017/0088301 | A1 | 3/2017 | Riemenschneider, III |
| 2017/0327260 | A1 | 11/2017 | Lancaster |
| 2018/0022488 | A1 | 1/2018 | Lancaster |
| 2018/0162660 | A1 | 6/2018 | Saylor |
| 2018/0273226 | A1 | 8/2018 | Lancaster et al. |
| 2018/0249637 | A1 | 9/2018 | Kraus et al. |
| 2018/0273218 | A1 | 9/2018 | Lancaster et al. |
| 2019/0002138 | A1 | 1/2019 | Laghi |

FOREIGN PATENT DOCUMENTS

| | | | |
|---|---|---|---|
| DE | 3140972 | | 6/1982 |
| DE | 3119038 | | 12/1982 |
| DE | 3634924 | | 4/1988 |
| DE | 3901704 | | 8/1990 |
| DE | 4234604 | | 4/1994 |
| DE | 19509649 | | 9/1996 |
| EP | 0096635 | | 12/1983 |
| EP | 0144266 | | 6/1985 |
| EP | 0246659 | | 11/1987 |
| EP | 0466980 | | 1/1992 |
| EP | 0653352 | | 5/1995 |
| EP | 0671324 | | 9/1995 |
| EP | 0811554 | | 12/1997 |
| EP | 0842850 | | 5/1998 |
| EP | 1125841 | | 8/2001 |
| EP | 1213223 | | 6/2002 |
| EP | 1489004 | | 12/2004 |
| EP | 1650573 | | 4/2006 |
| EP | 1705119 | | 9/2006 |
| EP | 1717149 | | 11/2006 |
| EP | 1736426 | | 12/2006 |
| EP | 1807308 | | 7/2007 |
| EP | 1736426 | | 10/2007 |
| EP | 2183974 | A1 | 5/2010 |
| EP | 3219628 | A1 * | 9/2017 |
| EP | 3353062 | | 8/2018 |
| EP | 3656685 | | 5/2020 |
| EP | 3733533 | | 11/2020 |
| GB | 1 546 523 | | 5/1979 |
| GB | 2059906 | | 4/1981 |
| GB | 2107668 | | 5/1983 |
| JP | S 57166252 | | 10/1982 |
| JP | S 63191707 | | 8/1988 |
| JP | S63218011 | | 9/1988 |
| JP | H 0385209 | | 4/1991 |
| JP | H 06239311 | | 8/1994 |
| JP | 09254913 | | 9/1997 |
| JP | 11165705 | | 6/1999 |
| JP | 2001048111 | | 2/2001 |
| JP | 2001072012 | | 3/2001 |
| JP | 2002211503 | | 7/2002 |
| JP | 2002362879 | | 12/2002 |
| JP | 2004161344 | | 6/2004 |
| JP | 3634993 | | 1/2005 |
| JP | 4350940 | | 10/2009 |
| WO | WO 9107341 | | 5/1991 |
| WO | WO 9420367 | | 9/1994 |
| WO | WO 9700202 | | 1/1997 |
| WO | WO 9822346 | | 5/1998 |
| WO | WO 2004069659 | | 8/2004 |
| WO | WO 2006110596 | | 10/2006 |
| WO | WO 2007071593 | | 6/2007 |
| WO | WO 2007100596 | | 9/2007 |
| WO | WO 2007100597 | | 9/2007 |
| WO | WO 2008007189 | | 1/2008 |
| WO | WO2008049148 | | 5/2008 |
| WO | WO 2008115868 | | 9/2008 |
| WO | WO 2008129432 | | 10/2008 |
| WO | WO2010130011 | | 11/2010 |

(56) References Cited

FOREIGN PATENT DOCUMENTS

| | | | | |
|---|---|---|---|---|
| WO | WO 2011057166 | | 5/2011 | |
| WO | WO 2012058549 | | 5/2012 | |
| WO | WO 2012058596 | | 5/2012 | |
| WO | WO2016057724 | A1 | 4/2016 | |
| WO | WO-2016057724 | A1 * | 4/2016 | ..... B65B 11/025 |
| WO | WO2017053603 | A1 | 3/2017 | |

OTHER PUBLICATIONS

European Patent Office; Communication in Application No. 18857679.7 dated May 11, 2021 (424EP).
"The Technology Behind a 'No Tear', 'No Rip' Film Carriage, and How to Explain it to your Customers," Jan. 21, 2010, downloaded from http://wulftecstretchwrapper.blogspt.com/2010_01_01archive.html on Jan. 7, 2011; 4 pages.
Petronio,S. Going the Distance. Machine Design 76.10 (2004): 3, S8, S10, S12. (Year: 2004).
ASTM International (2008). Standard Test Methods for Vibration Testing of Shipping Containers. D999-08. (Year: 2008).
ASTM International (2009). Standard Test Methods for Programmable Horizontal Impact Test for Shipping Containers and Systems. D4003-98. (Year: 2009).
Blumer, T., & Guadagnini, D. (2011). Shock transmissibility of a palletized load caused by forklift truck handling. Department of Industrial Technology, California Polytechnic State University . (Year:2011).
Cernokus, E. (2012). The Effect of Stretch Wrap Pre-stretch on Unitized Load Containment. M.S. Thesis, Department of Industrial Technology, California Polytechnic State University (Year: 2012).
Emblem, A. (2012). Packaging Technology—Fundamentals, Materials and Processed. Woodhead Publishing Ltd. (Year: 2012).
Crocker, Malcolm J. (2007). Handbook of Noise and Vibration Control. John Wiley & Sons. (Year: 2007).
Australian Patent Office; Notice of Acceptance in Application No. 2018338049 dated Dec. 10, 2021 (424AU).
Australian Patent Office; Examination Report in Application No. 2018338049 dated Feb. 12, 2021 (424AU).
International Search Report and Written Opinion in application PCT/IB2018/057341, dated Jan. 16, 2019.
Canadian Patent Office Office Action for Application No. 3,076,451 dated Aug. 12, 2020 (424CA).
Australian Patent Office; Examination Report in Application No. 2018338049 dated Nov. 11, 2021 (424AU).
U.S. Patent and Trademark Office, Notice of Allowance issued in U.S. Appl. No. 16/278,554 dated Nov. 28, 2022.

* cited by examiner

LOAD WRAPPING APPARATUS WRAP PROFILES WITH CONTROLLED WRAP CYCLE INTERRUPTIONS

FIELD OF THE INVENTION

The invention generally relates to wrapping loads with packaging material through relative rotation of loads and a packaging material dispenser, and in particular, to a control system therefor.

BACKGROUND OF THE INVENTION

Various packaging techniques have been used to build a load of unit products and subsequently wrap them for transportation, storage, containment and stabilization, protection and waterproofing. One system uses wrapping machines to stretch, dispense, and wrap packaging material around a load. The packaging material may be pre-stretched before it is applied to the load. Wrapping can be performed as an inline, automated packaging technique that dispenses and wraps packaging material in a stretch condition around a load on a pallet to cover and contain the load. Stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

In many commercial applications, typical loads wrapped by a stretch wrapping machine have a substantially cuboid shape with a relatively consistent length, width and height throughout, and in many cases having a similar length and width to the supporting pallet. Generally, in these applications, loads consist of multiple layers of the same products, and a standard wrapping cycle may be optimized to handle these standard-type loads. In other applications, however, loads may deviate from this traditional configuration, and may include portions or layers, herein referred to as inboard portions, that are substantially inboard of a supporting body upon which they are disposed and to which they must be secured. In still other instances, loads may have additional specialized requirements such as corner boards to protect the corners of the load, top sheets to protect loads from the environment, etc., which often requires dedicated machinery to handle in an automated fashion. Dedicated machinery, however, is not practical for all applications, as the cost of the machinery may exceed the derived benefits, particularly for lower cost wrapping machines and/or where specialized load requirements are only infrequently encountered.

Therefore, a continuing need exists in the art for a manner of accommodating specialized load requirements in a cost effective manner.

SUMMARY OF THE INVENTION

The invention addresses these and other problems associated with the art by providing in one aspect a method, apparatus and program product that utilize wrap profiles including controlled wrap cycle interruptions to handle specialized load requirements. The wrap profiles define additional wrap parameters for use in wrapping a load such that, through selection of a particular wrap profile, both the wrap parameters suitable for wrapping a load, as well as a controlled wrap cycle interruption suitable for handling a specialized requirement for the load, may be determined by a load wrapping apparatus when wrapping the load.

Therefore, consistent with one aspect of the invention, a method is provided for controlling a load wrapping apparatus of the type configured to wrap a load on a load support with packaging material dispensed from a packaging material dispenser through relative rotation between the packaging material dispenser and the load support. The method may include receiving input data selecting a wrap profile from among a plurality of wrap profiles for the load wrapping apparatus, where each of the plurality of wrap profiles includes a plurality of wrapping parameters that control operation of the load wrapping apparatus when wrapping, and where the selected wrap profile includes a wrapping parameter among the plurality of wrapping parameters that identifies a controlled wrap cycle interruption to be performed when wrapping the load, and performing a wrap cycle using the selected wrap profile to wrap the load with packaging material, including performing the controlled wrap cycle interruption during the wrap cycle.

In some embodiments, the controlled wrap cycle interruption temporarily pauses or stops relative rotation between the packaging material dispenser and the load support prior to completion of the wrap cycle. Also, in some embodiments, the controlled wrap cycle interruption temporarily decreases a relative rotation speed between the packaging material dispenser and the load support prior to completion of the wrap cycle. Also, in some embodiments, the controlled wrap cycle interruption prematurely terminates the wrap cycle prior to completion of the wrap cycle. Further, in some embodiments, the controlled wrap cycle interruption temporarily changes a dispense rate of the packaging material dispenser prior to completion of the wrap cycle.

Further, in some embodiments, the packaging material dispenser is configured for movement between a plurality of positions along a direction generally parallel to an axis about which packaging material is wrapped around the load when the load is disposed on the load support, and where the controlled wrap cycle interruption moves the packaging material dispenser to a selected position among the plurality of positions prior to completion of the wrap cycle.

In some embodiments, performing the controlled wrap cycle interruption includes notifying an operator. In addition, in some embodiments, notifying the operator includes displaying an alert to the operator on a display of the load wrapping apparatus. In some embodiments, notifying the operator includes displaying one or more instructions to the operator to prompt the operator to perform a manual activity associated with the controlled wrap cycle interruption.

In some embodiments, the controlled wrap cycle interruption includes a top box secure operation. In some embodiments, the top box secure operation includes, upon detecting a top of the load, temporarily reducing relative rotation speed and tension in a web of packaging material for one or more relative rotations to enable an operator to manually manipulate the web to secure an article on a top layer of the load.

In addition, in some embodiments, the controlled wrap cycle interruption includes an add corner boards operation. Moreover, in some embodiments, the add corner boards operation includes positioning the packaging material dispenser at a predetermined elevation and temporarily reducing relative rotation speed for a relative rotation to enable an operator to manually insert corner boards along each of a plurality of corners of the load.

In some embodiments, the controlled wrap cycle interruption includes an add top sheet operation. In some embodiments, the add top sheet operation includes, upon detecting a top of the load, lowering the packaging material dispenser to a predetermined elevation and pausing the wrap cycle to enable an operator to manually place a top sheet over the load, and where the add top sheet operation further includes, after restarting of the wrap cycle following placement of the top sheet, performing one or more relative rotations at a reduced relative rotation speed and resuming the wrap cycle.

Moreover, in some embodiments, the controlled wrap cycle interruption includes a one way wrap operation. In some embodiments, the one way wrap operation includes, upon detecting a top of the load, stopping the wrap cycle to enable an operator to cut a web of packaging material extending between the packaging material dispenser and the load.

In some embodiments, the controlled wrap cycle interruption includes a stack and wrap operation. In addition, in some embodiments, the stack and wrap operation includes, for each of a plurality of layers of the load, detecting a top of the load, and in response to detecting the top of the load, pausing the wrap cycle to enable an operator to manually place a next layer on top of the load. In some embodiments, the stack and wrap operation includes, for each of a plurality of layers of the load, detecting a top of the load, and in response to detecting the top of the load, pausing the wrap cycle and notifying an external machine to place a next layer on top of the load.

Moreover, in some embodiments, the controlled wrap cycle interruption includes a band two loads operation. Also, in some embodiments, the load is a first load, and the band two loads operation includes moving the packaging material dispenser to a predetermined position proximate a top of the first load in response to operator input and wrapping one or more bands of packaging material around the first load and a lower portion of a second load placed on top of the first load to secure the first and second loads to one another.

Some embodiments may also include causing a plurality of wrap profile indicators to be displayed on a display, each wrap profile indicator associated with a wrap profile from among the plurality of wrap profiles, where receiving the user input selecting the wrap profile includes receiving user input selecting the wrap profile indicator associated with the selected wrap profile. In addition, in some embodiments, each of the plurality of wrap profiles further specifies a minimum number of layers of packaging material and a wrap force to be applied to the load. Also, in some embodiments, the minimum number of layers and the wrap force specified by each wrap profile are selected to meet a load containment force requirement specified by such wrap profile. In addition, in some embodiments performing the wrap cycle further includes controlling the load wrapping apparatus to wrap the load using the minimum number of layers and wrap force specified by the selected wrap profile such that the load containment force requirement specified by the selected wrap profile is met when the load is wrapped.

Further, in some embodiments, the load has first and second opposing ends defined generally along a direction generally parallel to an axis about which packaging material is wrapped around the load when the load is disposed on the load support, where the load wrapping apparatus is further configured for movement of a portion of a web of packaging material relative to the load in the direction generally parallel to the axis, and where controlling the load wrapping apparatus includes, during relative rotation between the packaging material dispenser and the load support, controlling movement of the web of packaging material in the direction generally parallel to the axis to apply at least the minimum number of layers of packaging material specified by the selected wrap profile to the load throughout a contiguous region extending between first and second positions respectively disposed proximate the first and second opposing ends of the load, and controlling a dispense rate of the packaging material dispenser based on the wrap force specified by the selected wrap profile.

Also, in some embodiments, the load wrapping apparatus is configured to perform a standard wrapping operation that wraps packaging material in a spiral manner around a load starting and ending proximate a bottom of the load, where the controlled wrap cycle interruption deviates from the standard wrapping operation, and where the method further includes receiving second input data selecting a second wrap profile from among the plurality of wrap profiles that does not identify any controlled wrap cycle interruption to be performed when wrapping the load, and performing a second wrap cycle using the second wrap profile to wrap a second load with packaging material using the standard wrapping operation.

Consistent with another aspect of the invention, a method is provided for creating a wrap profile for a load wrapping apparatus of the type configured to wrap a load on a load support with packaging material dispensed from a packaging material dispenser through relative rotation between the packaging material dispenser and the load support. The method may include receiving first input data selecting a plurality of wrapping parameters that control operation of the load wrapping apparatus when wrapping the load, receiving second input data selecting a controlled wrap cycle interruption from among a plurality of controlled wrap cycle interruptions, where each of the controlled wrap cycle interruptions is configured to accommodate a specialized load requirement, and storing the selected plurality of wrapping parameters and the selected controlled wrap cycle interruption as a wrap profile in a wrap profile database accessible by the load wrapping apparatus.

Consistent with another aspect of the invention, a load wrapping apparatus may include a packaging material dispenser configured to dispense a web of packaging material to a load, a first drive mechanism configured to generate relative rotation between the packaging material and the load about an axis of rotation, a second drive mechanism configured to control an elevation of the web of packaging material generally parallel to the axis of rotation, and a controller coupled to the first and second drive mechanisms and configured to access a selected wrap profile from among a plurality of wrap profiles stored in a wrap profile database and control the first and second drive mechanisms while wrapping the load using the selected wrap profile, where each of the plurality of wrap profiles in the wrap profile database includes a plurality of wrapping parameters that control operation of the load wrapping apparatus when wrapping, where the selected wrap profile includes a wrapping parameter among the plurality of wrapping parameters that identifies a controlled wrap cycle interruption to be performed when wrapping the load, and where the controller is configured to perform the controlled wrap cycle interruption when wrapping the load using the selected wrap profile.

Consistent with another aspect of the invention, an apparatus may include a processor, and program code configured upon execution by the processor to control a load wrapping apparatus of the type configured to wrap a load on a load support with packaging material dispensed from a packaging material dispenser through relative rotation between the packaging material dispenser and the load support by performing any of the aforementioned methods. Also, in some embodiments, the processor is in a controller of the load wrapping apparatus, and the apparatus further includes a packaging material dispenser for dispensing packaging material to the load. Further, in some embodiments, the processor is in a device external to the load wrapping apparatus. In addition, in some embodiments, the device is a mobile device, a single-user computer or a multi-user computer.

Consistent with another aspect of the invention, a program product may include a non-transitory computer readable medium, and program code stored on the non-transitory computer readable medium and configured to control a load wrapping apparatus of the type configured to wrap a load on a load support with packaging material dispensed from a packaging material dispenser through relative rotation between the packaging material dispenser and the load support, where the program code is configured to control the load wrapping apparatus by performing any of the aforementioned methods.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

DETAILED DESCRIPTION

Embodiments consistent with the invention utilize wrap profiles with controlled wrap cycle interruptions to facilitate operator interaction with a load wrapping apparatus, particularly in connection with accommodating specialized load requirements. Prior to a discussion of the aforementioned concepts, however, a brief discussion of various types of wrapping apparatus within which the various techniques disclosed herein may be implemented is provided.

Wrapping Apparatus Configurations

Figure 1:
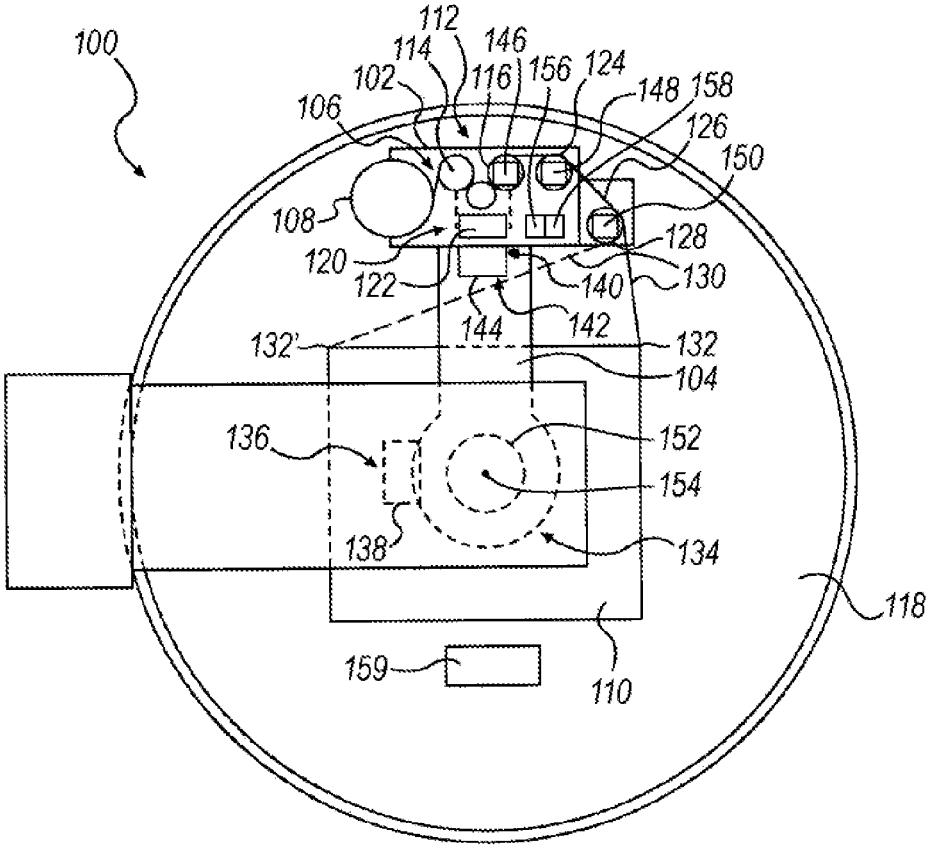
FIG. 1 shows a top view of a rotating arm-type wrapping apparatus consistent with the invention.

FIG. 1, for example, illustrates a rotating arm-type wrapping apparatus 100, which includes a roll carriage 102 mounted on a rotating arm 104. Roll carriage 102 may include a packaging material dispenser 106. Packaging material dispenser 106 may be configured to dispense packaging material 108 as rotating arm 104 rotates relative to a load 110 to be wrapped. In an example embodiment, packaging material dispenser 106 may be configured to dispense stretch wrap packaging material. As used herein, stretch wrap packaging material is defined as material having a high yield coefficient to allow the material a large amount of stretch during wrapping. However, it is possible that the apparatuses and methods disclosed herein may be practiced with packaging material that will not be pre-stretched prior to application to the load. Examples of such packaging material include netting, strapping, banding, tape, etc. The invention is therefore not limited to use with stretch wrap packaging material. In addition, as used herein, the terms "packaging material," "web," "film," "film web," and "packaging material web" may be used interchangeably.

Packaging material dispenser 106 may include a pre-stretch assembly 112 configured to pre-stretch packaging material before it is applied to load 110 if pre-stretching is desired, or to dispense packaging material to load 110 without pre-stretching. Pre-stretch assembly 112 may include at least one packaging material dispensing roller, including, for example, an upstream dispensing roller 114 and a downstream dispensing roller 116. It is contemplated that pre-stretch assembly 112 may include various configurations and numbers of pre-stretch rollers, drive or driven roller and idle rollers without departing from the spirit and scope of the invention.

The terms "upstream" and "downstream," as used in this application, are intended to define positions and movement relative to the direction of flow of packaging material 108 as it moves from packaging material dispenser 106 to load 110. Movement of an object toward packaging material dispenser 106, away from load 110, and thus, against the direction of flow of packaging material 108, may be defined as "upstream." Similarly, movement of an object away from packaging material dispenser 106, toward load 110, and thus, with the flow of packaging material 108, may be defined as "downstream." Also, positions relative to load 110 (or a load support surface 118) and packaging material dispenser 106 may be described relative to the direction of packaging material flow. For example, when two pre-stretch rollers are present, the pre-stretch roller closer to packaging material dispenser 106 may be characterized as the "upstream" roller and the pre-stretch roller closer to load 110

(or load support 118) and further from packaging material dispenser 106 may be characterized as the "downstream" roller.

A packaging material drive system 120, including, for example, an electric motor 122, may be used to drive dispensing rollers 114 and 116. For example, electric motor 122 may rotate downstream dispensing roller 116. Downstream dispensing roller 116 may be operatively coupled to upstream dispensing roller 114 by a chain and sprocket assembly, such that upstream dispensing roller 114 may be driven in rotation by downstream dispensing roller 116. Other connections may be used to drive upstream roller 114 or, alternatively, a separate drive (not shown) may be provided to drive upstream roller 114.

Downstream of downstream dispensing roller 116 may be provided one or more idle rollers 124, 126 that redirect the web of packaging material, with the most downstream idle roller 126 effectively providing an exit point 128 from packaging material dispenser 102, such that a portion 130 of packaging material 108 extends between exit point 128 and a contact point 132 where the packaging material engages load 110 (or alternatively contact point 132' if load 110 is rotated in a counter-clockwise direction).

Wrapping apparatus 100 also includes a relative rotation assembly 134 configured to rotate rotating arm 104, and thus, packaging material dispenser 106 mounted thereon, relative to load 110 as load 110 is supported on load support surface 118. Relative rotation assembly 134 may include a rotational drive system 136, including, for example, an electric motor 138. It is contemplated that rotational drive system 136 and packaging material drive system 120 may run independently of one another. Thus, rotation of dispensing rollers 114 and 116 may be independent of the relative rotation of packaging material dispenser 106 relative to load 110. This independence allows a length of packaging material 108 to be dispensed per a portion of relative revolution that is neither predetermined nor constant. Rather, the length may be adjusted periodically or continuously based on changing conditions.

Wrapping apparatus 100 may further include a lift assembly 140. Lift assembly 140 may be powered by a lift drive system 142, including, for example, an electric motor 144, that may be configured to move roll carriage 102 vertically relative to load 110. Lift drive system 142 may drive roll carriage 102, and thus packaging material dispenser 106, upwards and downwards vertically on rotating arm 104 while roll carriage 102 and packaging material dispenser 106 are rotated about load 110 by rotational drive system 136, to wrap packaging material spirally about load 110.

One or more of downstream dispensing roller 116, idle roller 124 and idle roller 126 may include a corresponding sensor 146, 148, 150 to monitor rotation of the respective roller. In particular, rollers 116, 124 and/or 126, and/or packaging material 108 dispensed thereby, may be used to monitor a dispense rate of packaging material dispenser 106, e.g., by monitoring the rotational speed of rollers 116, 124 and/or 126, the number of rotations undergone by such rollers, the amount and/or speed of packaging material dispensed by such rollers, and/or one or more performance parameters indicative of the operating state of packaging material drive system 120, including, for example, a speed of packaging material drive system 120. The monitored characteristics may also provide an indication of the amount of packaging material 108 being dispensed and wrapped onto load 110. In addition, in some embodiments a sensor, e.g., sensor 148 or 150, may be used to detect a break in the packaging material.

Wrapping apparatus also includes an angle sensor 152 for determining an angular relationship between load 110 and packaging material dispenser 106 about a center of rotation 154 (through which projects an axis of rotation that is perpendicular to the view illustrated in FIG. 1). Angle sensor 152 may be implemented, for example, as a rotary encoder, or alternatively, using any number of alternate sensors or sensor arrays capable of providing an indication of the angular relationship and distinguishing from among multiple angles throughout the relative rotation, e.g., an array of proximity switches, optical encoders, magnetic encoders, electrical sensors, mechanical sensors, photodetectors, motion sensors, etc. The angular relationship may be represented in some embodiments in terms of degrees or fractions of degrees, while in other embodiments a lower resolution may be adequate. It will also be appreciated that an angle sensor consistent with the invention may also be disposed in other locations on wrapping apparatus 100, e.g., about the periphery or mounted on arm 104 or roll carriage 102. In addition, in some embodiments angular relationship may be represented and/or measured in units of time, based upon a known rotational speed of the load relative to the packaging material dispenser, from which a time to complete a full revolution may be derived such that segments of the revolution time would correspond to particular angular relationships.

Additional sensors, such as a load distance sensor 156 and/or a film angle sensor 158, may also be provided on wrapping apparatus 100. Wrapping apparatus 100 may also include additional components used in connection with other aspects of a wrapping operation. For example, a clamping device 159 may be used to grip the leading end of packaging material 108 between cycles. In addition, a conveyor (not shown) may be used to convey loads to and from wrapping apparatus 100. Other components commonly used on a wrapping apparatus will be appreciated by one of ordinary skill in the art having the benefit of the instant disclosure.

Figure 2:
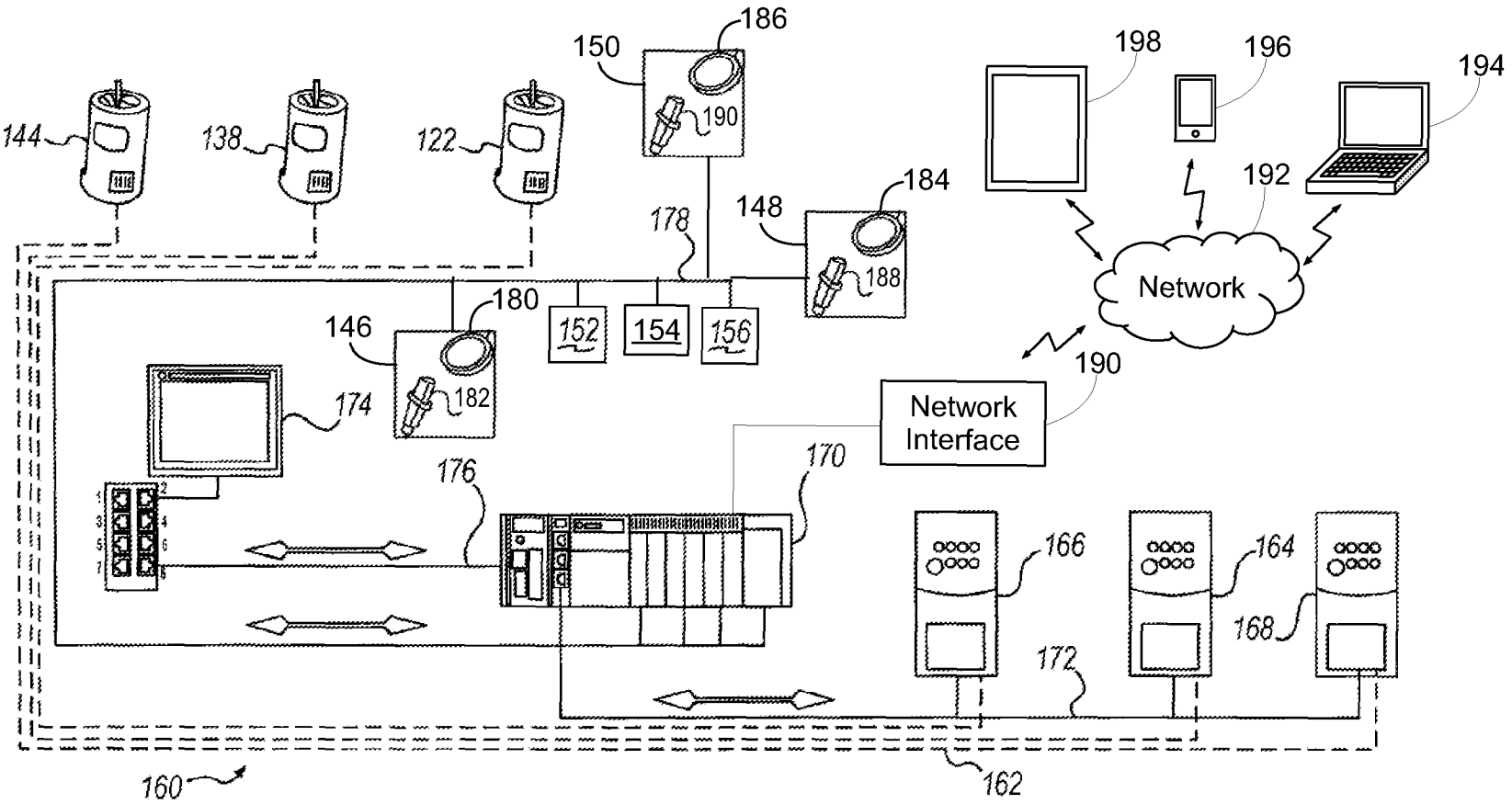
FIG. 2 is a schematic view of an exemplary control system for use in the apparatus of FIG. 1.

An example schematic of a control system 160 for wrapping apparatus 100 is shown in FIG. 2. Motor 122 of packaging material drive system 120, motor 138 of rotational drive system 136, and motor 144 of lift drive system 142 may communicate through one or more data links 162 with a rotational drive variable frequency drive ("VFD") 164, a packaging material drive VFD 166, and a lift drive VFD 168, respectively (other types of drives may be used in other embodiments). Rotational drive VFD 164, packaging material drive VFD 166, and lift drive VFD 168 may communicate with controller 170 through a data link 172. It should be understood that rotational drive VFD 164, packaging material drive VFD 166, and lift drive VFD 168 may produce outputs to controller 170 that controller 170 may use as indicators of rotational movement. For example, packaging material drive VFD 166 may provide controller 170 with signals similar to signals provided by sensor 146, and thus, sensor 146 may be omitted to cut down on manufacturing costs.

Controller 170 in the embodiment illustrated in FIG. 2 is a local controller that is physically co-located with the packaging material drive system 120, rotational drive system 136 and lift drive system 142 (although controller 170 could be remotely located in other embodiments). Controller 170 may include hardware components and/or software program code that allow it to receive, process, and transmit data. It is contemplated that controller 170 may be implemented as a programmable logic controller (PLC), or may otherwise operate similar to a processor in a computer system. Controller 170 may communicate with an operator interface 174 via a data link 176. Operator interface 174 may include a display or screen and controls that provide an operator with a way to monitor, program, and operate wrapping apparatus 100. For example, an operator may use operator interface 174 to enter or change predetermined and/or desired settings and values, or to start, stop, or pause the wrapping cycle. Controller 170 may also communicate with one or more sensors, e.g., sensors 146, 148, 150, 152, 154 and 156, as well as others not illustrated in FIG. 2, through a data link 178, thus allowing controller 170 to receive performance related data during wrapping. It is contemplated that data links 162, 172, 176, and 178 may include any suitable wired and/or wireless communications media known in the art.

As noted above, sensors 146, 148, 150, 152 may be configured in a number of manners consistent with the invention. In one embodiment, for example, sensor 146 may be configured to sense rotation of downstream dispensing roller 116, and may include one or more magnetic transducers 180 mounted on downstream dispensing roller 116, and a sensing device 182 configured to generate a pulse when the one or more magnetic transducers 180 are brought into proximity of sensing device 182. Alternatively, sensor assembly 146 may include an encoder configured to monitor rotational movement, and capable of producing, for example, 360 or 720 signals per revolution of downstream dispensing roller 116 to provide an indication of the speed or other characteristic of rotation of downstream dispensing roller 116. The encoder may be mounted on a shaft of downstream dispensing roller 116, on electric motor 122, and/or any other suitable area. One example of a sensor assembly that may be used is an Encoder Products Company model 15H optical encoder. Other suitable sensors and/or encoders may be used for monitoring, such as, for example, optical encoders, magnetic encoders, electrical sensors, mechanical sensors, photodetectors, and/or motion sensors.

Likewise, for sensors 148 and 150, magnetic transducers 184, 186 and sensing devices 188, 190 may be used to monitor rotational movement, while for sensor 152, a rotary encoder may be used to determine the angular relationship between the load and packaging material dispenser. Any of the aforementioned alternative sensor configurations may be used for any of sensors 146, 148, 150, 152, 154 and 156 in other embodiments, and as noted above, one or more of such sensors may be omitted in some embodiments. Additional sensors capable of monitoring other aspects of the wrapping operation may also be coupled to controller 170 in other embodiments.

For the purposes of the invention, controller 170 may represent practically any type of computer, computer system, controller, logic controller, or other programmable electronic device, and may in some embodiments be implemented using one or more networked computers or other electronic devices, whether located locally or remotely with respect to the various drive systems 120, 136 and 142 of wrapping apparatus 100.

Controller 170 typically includes a central processing unit including at least one microprocessor coupled to a memory, which may represent the random access memory (RAM) devices comprising the main storage of controller 170, as well as any supplemental levels of memory, e.g., cache memories, non-volatile or backup memories (e.g., programmable or flash memories), read-only memories, etc. In addition, the memory may be considered to include memory storage physically located elsewhere in controller 170, e.g., any cache memory in a processor in CPU 52, as well as any storage capacity used as a virtual memory, e.g., as stored on a mass storage device or on another computer or electronic device coupled to controller 170. Controller 170 may also include one or more mass storage devices, e.g., a floppy or other removable disk drive, a hard disk drive, a direct access storage device (DASD), an optical drive (e.g., a CD drive, a DVD drive, etc.), and/or a tape drive, among others. Furthermore, controller 170 may include an interface 190 with one or more networks 192 (e.g., a LAN, a WAN, a wireless network, and/or the Internet, among others) to permit the communication of information to the components in wrapping apparatus 100 as well as with other computers and electronic devices, e.g. computers such as a single-user desktop computer or laptop computer 194, mobile devices such as a mobile phone 196 or tablet 198, multi-user computers such as servers or cloud resources, etc. Controller 170 operates under the control of an operating system, kernel and/or firmware and executes or otherwise relies upon various computer software applications, components, programs, objects, modules, data structures, etc. Moreover, various applications, components, programs, objects, modules, etc. may also execute on one or more processors in another computer coupled to controller 170, e.g., in a distributed or client-server computing environment, whereby the processing required to implement the functions of a computer program may be allocated to multiple computers over a network.

In general, the routines executed to implement the embodiments of the invention, whether implemented as part of an operating system or a specific application, component, program, object, module or sequence of instructions, or even a subset thereof, will be referred to herein as "computer program code," or simply "program code." Program code typically comprises one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning controllers, computers and computer systems, those skilled in the art will appreciate that the various embodiments of the invention are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by controller 170. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

Various program code described hereinafter may be identified based upon the application within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

In the discussion hereinafter, the hardware and software used to control wrapping apparatus 100 is assumed to be incorporated wholly within components that are local to wrapping apparatus 100 illustrated in FIGS. 1-2, e.g., within components 162-178 described above. It will be appreciated, however, that in other embodiments, at least a portion of the functionality incorporated into a wrapping apparatus may be implemented in hardware and/or software that is external to the aforementioned components. For example, in some embodiments, some user interaction may be performed using a networked computer or mobile device, with the networked computer or mobile device converting user input into control variables that are used to control a wrapping operation. In other embodiments, user interaction may be implemented using a web-type interface, and the conversion of user input may be performed by a server or a local controller for the wrapping apparatus, and thus external to a networked computer or mobile device. In still other embodiments, a central server may be coupled to multiple wrapping stations to control the wrapping of loads at the different stations. As such, the operations of receiving user input, converting the user input into control variables for controlling a wrap operation, initiating and implementing a wrap operation based upon the control variables, providing feedback to a user, etc., may be implemented by various local and/or remote components and combinations thereof in different embodiments. In this regard, a controller or processor incorporated therein may be configured to interact with an operator interface that is either local to or remote from the controller/processor. In some embodiments, for example, a processor may be implemented within a local controller for a wrapping apparatus, and may cause an operator interface of the wrapping apparatus to display information by directly controlling the local display. In other embodiments, a processor may be implemented within a device that is external to a load wrapping apparatus such as a single-user computer or a mobile device, and may cause an operator interface of the external device to display information by directly controlling the external device display. In still other embodiments, a processor may be implemented within a local controller for a wrapping apparatus or a multi-user computer such as a web server, and may cause an operator interface of a remote device to display information by sending information that is decoded locally on the external device, e.g., through the communication of a web page to a web browser on the external device, or through the communication of information to an application running on the external device. Further, it will be appreciated that in some instances, a processor that determines wrap profiles and/or various wrap parameters may be remote from a wrapping apparatus, and may, for example, communicate such information to a wrapping apparatus and/or to a database for later retrieval by a wrapping apparatus. Additional variations may be contemplated, and as such, the invention is not limited to the particular allocations of functionality described herein.

Figure 3:
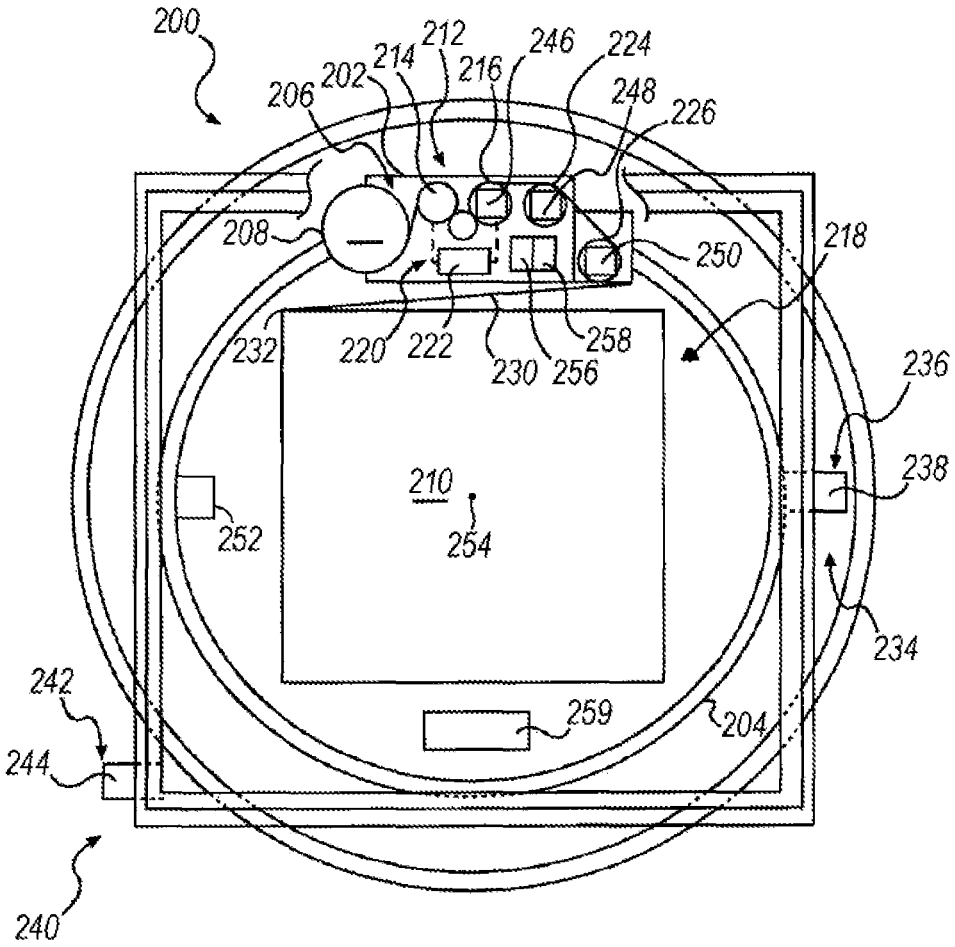
FIG. 3 shows a top view of a rotating ring-type wrapping apparatus consistent with the invention.

Now turning to FIG. 3, a rotating ring-type wrapping apparatus 200 is illustrated. Wrapping apparatus 200 may include elements similar to those shown in relation to wrapping apparatus 100 of FIG. 1, including, for example, a roll carriage 202 including a packaging material dispenser 206 configured to dispense packaging material 208 during relative rotation between roll carriage 202 and a load 210 disposed on a load support 218. However, a rotating ring 204 is used in wrapping apparatus 200 in place of rotating arm 104 of wrapping apparatus 100. In many other respects, however, wrapping apparatus 200 may operate in a manner similar to that described above with respect to wrapping apparatus 100.

Packaging material dispenser 206 may include a pre-stretch assembly 212 including an upstream dispensing roller 214 and a downstream dispensing roller 216, and a packaging material drive system 220, including, for example, an electric motor 222, may be used to drive dispensing rollers 214 and 216. Downstream of downstream dispensing roller 216 may be provided one or more idle rollers 224, 226, with the most downstream idle roller 226 effectively providing an exit point 228 from packaging material dispenser 206, such that a portion 230 of packaging material 208 extends between exit point 228 and a contact point 232 where the packaging material engages load 210.

Wrapping apparatus 200 also includes a relative rotation assembly 234 configured to rotate rotating ring 204, and thus, packaging material dispenser 206 mounted thereon, relative to load 210 as load 210 is supported on load support surface 218. Relative rotation assembly 234 may include a rotational drive system 236, including, for example, an electric motor 238. Wrapping apparatus 200 may further include a lift assembly 240, which may be powered by a lift drive system 242, including, for example, an electric motor 244, that may be configured to move rotating ring 204 and roll carriage 202 vertically relative to load 210.

In addition, similar to wrapping apparatus 100, wrapping apparatus 200 may include sensors 246, 248, 250 on one or more of downstream dispensing roller 216, idle roller 224 and idle roller 226. Furthermore, an angle sensor 252 may be provided for determining an angular relationship between load 210 and packaging material dispenser 206 about a center of rotation 254 (through which projects an axis of rotation that is perpendicular to the view illustrated in FIG. 3), and in some embodiments, one or both of a load distance sensor 256 and a film angle sensor 258 may also be provided. Sensor 252 may be positioned proximate center of rotation 254, or alternatively, may be positioned at other locations, such as proximate rotating ring 204. Wrapping apparatus 200 may also include additional components used in connection with other aspects of a wrapping operation, e.g., a clamping device 259 may be used to grip the leading end of packaging material 208 between cycles.

Figure 4:
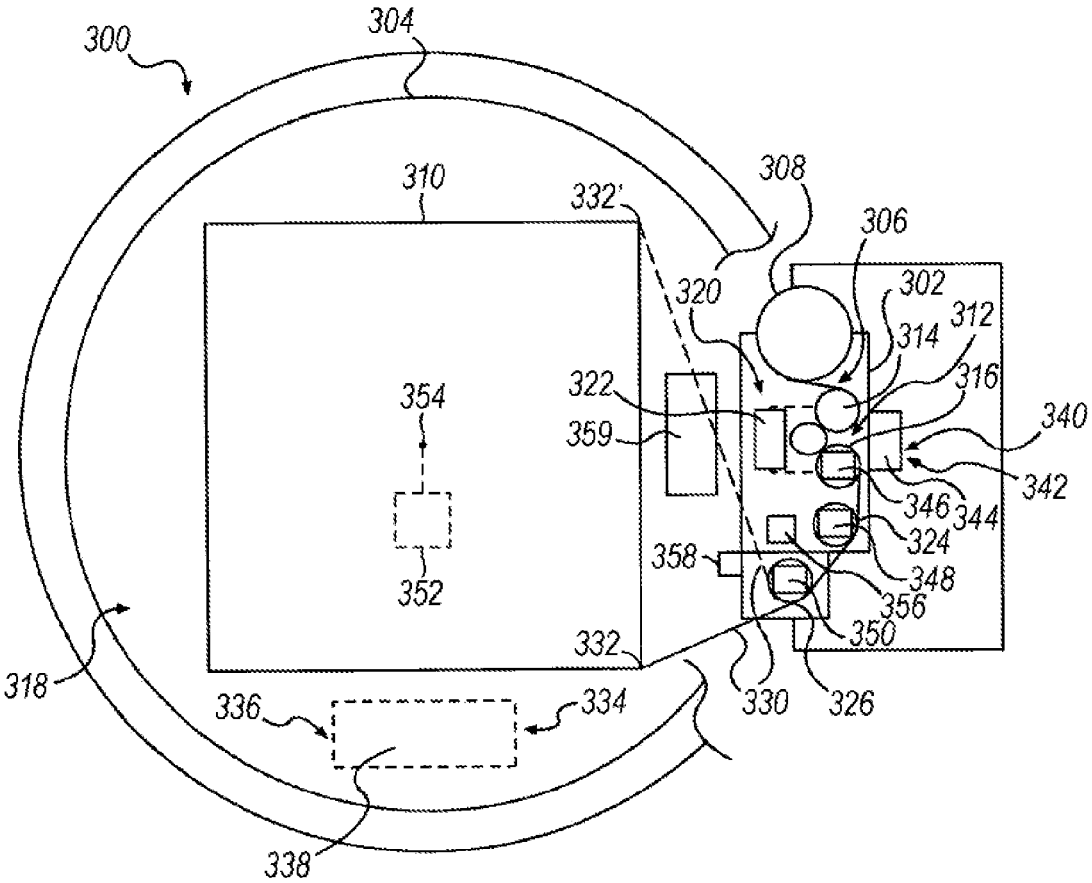
FIG. 4 shows a top view of a turntable-type wrapping apparatus consistent with the invention.

FIG. 4 likewise shows a turntable-type wrapping apparatus 300, which may also include elements similar to those shown in relation to wrapping apparatus 100 of FIG. 1. However, instead of a roll carriage 102 that rotates around a fixed load 110 using a rotating arm 104, as in FIG. 1, wrapping apparatus 300 includes a rotating turntable 304 functioning as a load support 318 and configured to rotate load 310 about a center of rotation 354 (through which projects an axis of rotation that is perpendicular to the view illustrated in FIG. 4) while a packaging material dispenser 306 disposed on a dispenser support 302 remains in a fixed location about center of rotation 354 while dispensing packaging material 308. In many other respects, however, wrapping apparatus 300 may operate in a manner similar to that described above with respect to wrapping apparatus 100.

Packaging material dispenser 306 may include a prestretch assembly 312 including an upstream dispensing roller 314 and a downstream dispensing roller 316, and a packaging material drive system 320, including, for example, an electric motor 322, may be used to drive dispensing rollers 314 and 316, and downstream of downstream dispensing roller 316 may be provided one or more idle rollers 324, 326, with the most downstream idle roller 326 effectively providing an exit point 328 from packaging material dispenser 306, such that a portion 330 of packaging material 308 extends between exit point 328 and a contact point 332 (or alternatively contact point 332' if load 310 is rotated in a counter-clockwise direction) where the packaging material engages load 310.

Wrapping apparatus 300 also includes a relative rotation assembly 334 configured to rotate turntable 304, and thus, load 310 supported thereon, relative to packaging material dispenser 306. Relative rotation assembly 334 may include a rotational drive system 336, including, for example, an electric motor 338. Wrapping apparatus 300 may further include a lift assembly 340, which may be powered by a lift drive system 342, including, for example, an electric motor 344, that may be configured to move dispenser support 302 and packaging material dispenser 306 vertically relative to load 310.

In addition, similar to wrapping apparatus 100, wrapping apparatus 300 may include sensors 346, 348, 350 on one or more of downstream dispensing roller 316, idle roller 324 and idle roller 326. Furthermore, an angle sensor 352 may be provided for determining an angular relationship between load 310 and packaging material dispenser 306 about a center of rotation 354, and in some embodiments, one or both of a load distance sensor 356 and a film angle sensor 358 may also be provided. Sensor 352 may be positioned proximate center of rotation 354, or alternatively, may be positioned at other locations, such as proximate the edge of turntable 304. Wrapping apparatus 300 may also include additional components used in connection with other aspects of a wrapping operation, e.g., a clamping device 359 may be used to grip the leading end of packaging material 308 between cycles.

Each of wrapping apparatus 200 of FIG. 3 and wrapping apparatus 300 of FIG. 4 may also include a controller (not shown) similar to controller 170 of FIG. 2, and receive signals from one or more of the aforementioned sensors and control packaging material drive system 220, 320 during relative rotation between load 210, 310 and packaging material dispenser 206, 306.

Those skilled in the art will recognize that the example environments illustrated in FIGS. 1-4 are not intended to limit the present invention. Indeed, those skilled in the art will recognize that other alternative environments may be used without departing from the scope of the invention.

Wrapping Operation

During a typical wrapping operation, a clamping device, e.g., as known in the art, is used to position a leading edge of the packaging material on the load such that when relative rotation between the load and the packaging material dispenser is initiated, the packaging material will be dispensed from the packaging material dispenser and wrapped around the load. In addition, where prestretching is used, the packaging material is stretched prior to being conveyed to the load. The dispense rate of the packaging material is controlled during the relative rotation between the load and the packaging material, and a lift assembly controls the position, e.g., the height, of the web of packaging material engaging the load so that the packaging material is wrapped in a spiral manner around the load from the base or bottom of the load to the top. Multiple layers of packaging material may be wrapped around the load over multiple passes to increase overall containment force, and once the desired amount of packaging material is dispensed, the packaging material is severed to complete the wrap.

In the illustrated embodiments, to control the overall containment force of the packaging material applied to the load, both the wrap force and the position of the web of packaging material are both controlled to provide the load with a desired overall containment force. The mechanisms by which each of these aspects of a wrapping operation are controlled are provided below.

Wrap Force Control

In many wrapping applications, the rate at which packaging material is dispensed by a packaging material dispenser of a wrapping apparatus is controlled based on a desired payout percentage, which in general relates to the amount of wrap force applied to the load by the packaging material during wrapping. Further details regarding the concept of payout percentage may be found, for example, in the aforementioned U.S. Pat. No. 7,707,801, which is assigned to the same assignee as the present application, and which is incorporated by reference herein in its entirety.

In many embodiments, for example, a payout percentage may have a range of about 80% to about 120%. Decreasing the payout percentage slows the rate at which packaging material exits the packaging material dispenser compared to the relative rotation of the load such that the packaging material is pulled tighter around the load, thereby increasing wrap force, and as a consequence, the overall containment force applied to the load. In contrast, increasing the payout percentage decreases the wrap force. For the purposes of simplifying the discussion hereinafter, however, a payout percentage of 100% is initially assumed.

It will be appreciated, however, that other metrics may be used as an alternative to payout percentage to reflect the relative amount of wrap force to be applied during wrapping, so the invention is not so limited. In particular, to simplify the discussion, the term "wrap force" will be used herein to generically refer to any metric or parameter in a wrapping apparatus that may be used to control how tight the packaging material is pulled around a load at a given instant. Wrap force, as such, may be based on the amount of tension induced in a web of packaging material extending between the packaging material dispenser and the load, which in some embodiments may be measured and controlled directly, e.g., through the use of an electronic load cell coupled to a roller over which the packaging material passes, a spring-loaded dancer interconnected with a sensor, a torque control device, or any other suitable sensor capable of measuring force or tension in a web of packaging material.

On the other hand, because the amount of tension that is induced in a web of packaging material is fundamentally based upon the relationship between the feed rate of the packaging material and the rate of relative rotation of the load (i.e., the demand rate of the load), wrap force may also refer to various metrics or parameters related to the rate at which the packaging material is dispensed by a packaging material dispenser.

Thus, a payout percentage, which relates the rate at which the packaging material is dispensed by the packaging material dispenser to the rate at which the load is rotated relative to the packaging material dispenser, may be a suitable wrap force parameter in some embodiments. Alternatively, a dispense rate, e.g., in terms of the absolute or relative linear rate at which packaging material exits the packaging material dispenser, or the absolute or relative rotational rate at which an idle or driven roller in the packaging material dispenser or otherwise engaging the packaging material rotates, may also be a suitable wrap force parameter in some embodiments.

To control wrap force in a wrapping apparatus, a number of different control methodologies may be used. For example, in some embodiments of the invention, the effective circumference of a load may be used to dynamically control the rate at which packaging material is dispensed to a load when wrapping the load with packaging material during relative rotation established between the load and a packaging material dispenser, and thus control the wrap force applied to the load by the packaging material, e.g., as is disclosed in U.S. Pub. No. 2014/0116007, which is assigned to the same assignee as the present application, and which is incorporated by reference herein in its entirety. The effective circumference of a load throughout relative rotation may be indicative of an effective consumption rate of the load, which may in turn be indicative of the amount of packaging material being "consumed" by the load as the load rotates relative to the packaging dispenser. In particular, effective consumption rate, as used herein, generally refers to a rate at which packaging material would need to be dispensed by the packaging material dispenser in order to substantially match the tangential velocity of a tangent circle that is substantially centered at the center of rotation of the load and substantially tangent to a line substantially extending between a first point proximate to where the packaging material exits the dispenser and a second point proximate to where the packaging material engages the load. This line is generally coincident with the web of packaging material between where the packaging material exits the dispenser and where the packaging material engages the load.

The manner in which the dimensions (i.e., circumference, diameter and/or radius) of the tangent circle may be calculated or otherwise determined may vary in different embodiments. In some embodiments, for example, a sensed film angle may be used to determine various dimensions of a tangent circle, e.g., effective radius and/or effective circumference. Alternatively or in addition to the use of sensed film angle, various additional inputs may be used to determine dimensions of a tangent circle. For example, a film speed sensor, such as an optical or magnetic encoder on an idle roller, may be used to determine the speed of the packaging material as the packaging material exits the packaging material dispenser. In addition, a laser or other distance sensor may be used to determine a load distance (i.e., the distance between the surface of the load at a particular rotational position and a reference point about the periphery of the load). Furthermore, the dimensions of the load, e.g., length, width and/or offset, may either be input manually by a user, may be received from a database or other electronic data source, or may be sensed or measured.

Other manners of directly or indirectly controlling wrap force may be used in other embodiments without departing from the spirit and scope of the invention, including various techniques and variations disclosed in the aforementioned materials incorporated by reference herein, as well as other wrap speed or wrap force-based control packaging material dispense techniques known in the art.

Web Position Control

Figure 5:
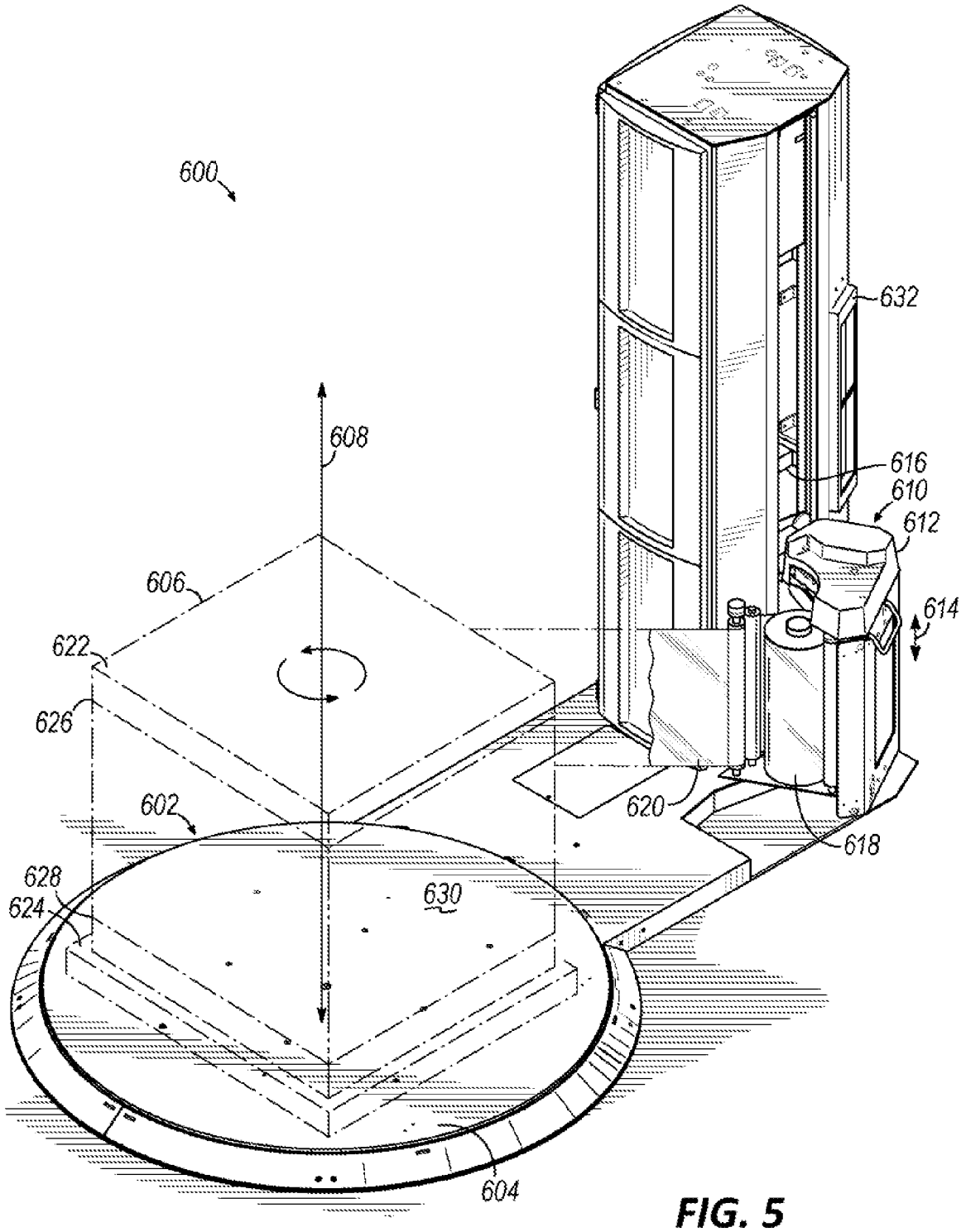
FIG. 5 is a perspective view of a turntable-type wrapping apparatus consistent with the invention.

As noted above, during a wrapping operation, the position of the web of packaging material is typically controlled to wrap the load in a spiral manner. FIG. 5, for example, illustrates a turntable-type wrapping apparatus 600 similar to wrapping apparatus 300 of FIG. 4, including a load support 602 configured as a rotating turntable 604 for supporting a load 606. Turntable 604 rotates about an axis of rotation 608, e.g., in a counter-clockwise direction as shown in FIG. 5.

A packaging material dispenser 610, including a roll carriage 612, is configured for movement along a direction 614 by a lift mechanism 616. Roll carriage 612 supports a roll 618 of packaging material, which during a wrapping operation includes a web 620 extending between packaging material dispenser 610 and load 606.

Direction 614 is generally parallel to an axis about which packaging material is wrapped around load 606, e.g., axis 608, and movement of roll carriage 612, and thus web 620, along direction 614 during a wrapping operation enables packaging material to be wrapped spirally around the load.

In some embodiments, it may be desirable to provide at least a minimum number of layers of packaging material within a contiguous region on a load. For example, load 606 includes opposing ends along axis 608, e.g., a top 622 and bottom 624 for a load wrapped about a vertically oriented axis 608, and it may be desirable to wrap packaging material between two positions 626 and 628 defined along direction 614 and respectively proximate top 622 and bottom 624. Positions 626, 628 define a region 630 therebetween that, in the illustrated embodiments, is provided with at least a minimum number of layers of packaging material throughout.

The position of roll carriage 612 may be sensed using a sensing device (not shown in FIG. 5), which may include any suitable reader, encoder, transducer, detector, or sensor capable of determining the position of the roll carriage, another portion of the packaging material dispenser, or of the web of packaging material itself relative to load 606 along direction 614. It will be appreciated that while a vertical direction 614 is illustrated in FIG. 5, and thus the position of roll carriage 612 corresponds to a height, in other embodiments where a load is wrapped about an axis other than a vertical axis, the position of the roll carriage may not be related to a height.

Control of the position of roll carriage 612, as well as of the other drive systems in wrapping apparatus 600, is provided by a controller 632, the details of which are discussed in further detail below.

Containment Force-Based Wrapping

Conventionally, stretch wrapping machines have controlled the manner in which packaging material is wrapped around a load by offering control input for the number of bottom wraps placed at the base of a load, the number of top wraps placed at the top of the load, and the speed of the roll carriage in the up and down traverse to manage overlaps of the spiral wrapped film. In some designs, these controls have been enhanced by controlling the overlap inches during the up and down travel taking into consideration the relative speed of rotation and roll carriage speed.

However, it has been found that conventional control inputs often do not provide optimal performance, as such control inputs often do not evenly distribute the containment forces on all areas of a load, and often leave some areas with insufficient containment force. Often, this is due to the relatively complexity of the control inputs and the need for experienced operators. Particularly with less experienced operators, operators react to excessive film breaks by reducing wrap force and inadvertently lowering cumulative containment forces below desirable levels.

Some embodiments consistent with the invention, on the other hand, utilize a containment force-based wrap control to simplify control over wrap parameters and facilitate even distribution of containment force applied to a load. In particular, in some embodiments of the invention, an operator specifies a load containment force requirement that is used, in combination with one or more attributes of the packaging material being used to wrap the load, to control the dispensing of packaging material to the load.

A load containment force requirement, for example, may include a minimum overall containment force to be applied over all concerned areas of a load (e.g., all areas over which packaging material is wrapped around the load). In some embodiments, a load containment force requirement may also include different minimum overall containment forces for different areas of a load, a desired range of containment forces for some or all areas of a load, a maximum containment force for some or all areas of a load.

A packaging material attribute may include, for example, an incremental containment force/revolution (ICF) attribute, which is indicative of the amount of containment force added to a load in a single revolution of packaging material around the load. The ICF attribute may be related to a wrap force or payout percentage, such that, for example, the ICF attribute is defined as a function of the wrap force or payout percentage at which the packaging material is being applied. In some embodiments, the ICF attribute may be linearly related to payout percentage, and include an incremental containment force at 100% payout percentage along with a slope that enables the incremental containment force to be calculated for any payout percentage. Alternatively, the ICF attribute may be defined with a more complex function, e.g., s-curve, interpolation, piecewise linear, exponential, multi-order polynomial, logarithmic, moving average, power, or other regression or curve fitting techniques. It will be appreciated that other attributes associated with the tensile strength of the packaging material may be used in the alternative.

Other packaging material attributes may include attributes associated with the thickness and/or weight of the packaging material, e.g., specified in terms of weight per unit length, such as weight in ounces per 1000 inches. Still other packaging material attributes may include a wrap force limit attribute, indicating, for example, a maximum wrap force or range of wrap forces with which to use the packaging material (e.g., a minimum payout percentage), a width attribute indicating the width (e.g., in inches) of the packaging material, and/or additional identifying attributes of a packaging material (e.g., manufacturer, model, composition, coloring, etc.), among others.

A load containment force requirement and a packaging material attribute may be used in a wrap control consistent with the invention to determine one or both of a wrap force to be used when wrapping a load with packaging material and a number of layers of packaging material to be applied to the load to meet the load containment force requirement. The wrap force and number of layers may be represented respectively by wrap force and layer parameters. The wrap force parameter may specify, for example, the desired wrap force to be applied to the load, e.g., in terms of payout percentage, or in terms of a dispense rate or force.

The layer parameter may specify, for example, a minimum number of layers of packaging material to be dispensed throughout a contiguous region of a load. In this regard, a contiguous region of a load may refer to a region of a load between two different relative elevations along an axis of relative rotation and throughout which it is desirable to apply packaging material. In some embodiments, the contiguous region may be considered to include all sides of a load, while in other embodiments, the contiguous region may refer to only a single side or subset of sides, or even to a line extending along a side of a load between different elevations.

With regard to the concept of a minimum number of layers of packaging material, a minimum number of layers of three, for example, means that at any point on the load within a contiguous region wrapped with packaging material, at least three overlapping layers of packaging material will overlay that point. Put differently, the number of layers may also be considered to represent a combined thickness of packaging material applied to the load. As such, in some embodiments, the layer parameter may be specified in terms of a minimum combined thickness of packaging material to be dispensed through a contiguous region of a load. In some embodiments, the combined thickness may be represented in terms of layers, while in other embodiments, the combined thickness may be represented in terms of the actual packaging material thickness represented by the combined layers of packaging material applied to the load. Nonetheless, for the purposes of this disclosure, the terms "number of layers" and "combined thickness" may be used interchangeably.

In addition, while a layer parameter in the embodiments hereinafter is based upon a minimum value throughout a contiguous region of a load, in other embodiments, a layer parameter may be based on an average, median or other calculation related to the combined thickness of packaging material throughout at least a portion of the contiguous region.

Moreover, it will be appreciated that a layer parameter may specify other control parameters that, when utilized, provide the desired minimum number of layers or combined thickness, e.g., an amount of overlap between successive revolutions, a carriage or elevator speed, a number of up and/or down passes of the carriage or elevator, a number of relative revolutions, etc. For example, in some embodiments, carriage speed and the number of up and/or down passes may be used as layer parameters to provide a desired minimum number of layers or combined thickness of packaging material during a wrapping operation. In some other embodiments, however, no separate determination of minimum number of layers or combined thickness may be performed, and layer parameters based on overlap, carriage speed and/or number of passes may be used.

A layer parameter may also specify different number of layers for different portions of a load, and may include, for example, additional layers proximate the top and/or bottom of a load. Other layer parameters may include banding parameters (e.g., where multiple pallets are stacked together in one load).

Figure 6:
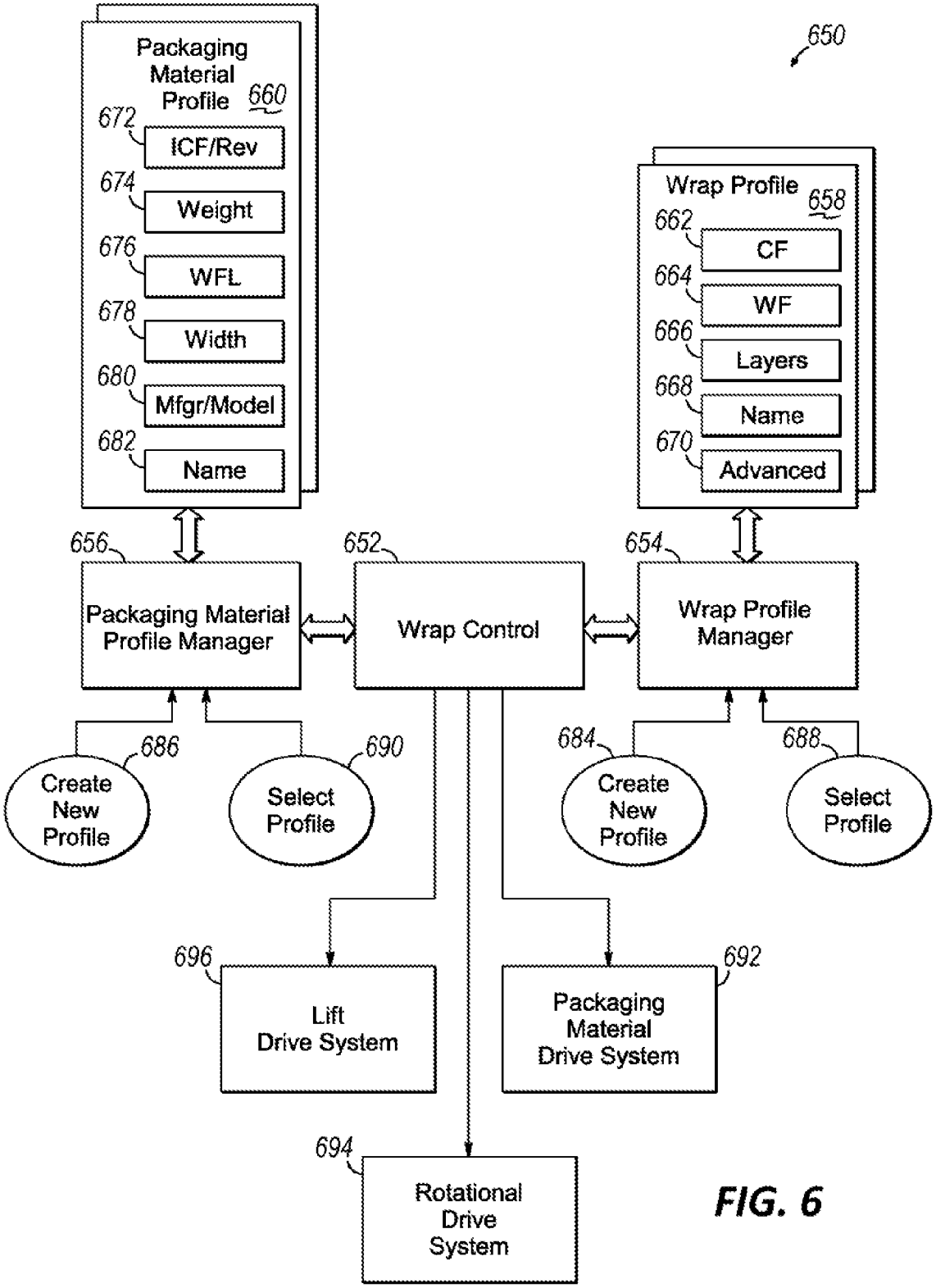
FIG. 6 is a block diagram illustrating an example wrap profile-based control system consistent with the invention.

Now turning to FIG. 6, an example control system 650 for a wrapping apparatus implements load containment force-based wrap control through the use of profiles. In particular, a wrap control block 652 is coupled to a wrap profile manager block 654 and a packaging material profile manager block 656, which respectively manage a plurality of wrap profiles 658 and packaging material profiles 660.

Each wrap profile 658 stores a plurality of wrap parameters, including, for example, a containment force parameter 662, a wrap force (or payout percentage) parameter 664, and a layer parameter 666. In addition, each wrap profile 658 may include a name parameter providing a name or other identifier for the profile. The name parameter may identify, for example, a type of load (e.g., a light stable load type, a moderate stable load type, a moderate unstable load type or a heavy unstable load type), or may include any other suitable identifier for a load (e.g., "20 oz bottles", "Acme widgets", etc.).

In addition, a wrap profile may include additional wrap parameters, collectively illustrated as advanced parameters 670, that may be used to specify additional instructions for wrapping a load. Additional parameters may include, for example, an overwrap parameter identifying the amount of overwrap on top of a load, a top parameter specifying an additional number of layers to be applied at the top of the load, a bottom parameter specifying additional number of layers to be applied at the bottom of the load, a pallet payout parameter specifying the payout percentage to be used to wrap a pallet supporting the load, a top wrap first parameter specifying whether to apply top wraps before bottom wraps, a variable load parameter specifying that loads are the same size from top to bottom, a variable layer parameter specifying that loads are not the same size from top to bottom, one or more rotation speed parameters (e.g., one rotation speed parameter specifying a rotational speed prior to a first top wrap and another rotation speed parameter specifying a rotational speed after the first top wrap), a band parameter specifying any additional layers to be applied at a band position, a band position parameter specifying a position of the band from the down limit, a load lift parameter specifying whether to raise the load with a load lift, a short parameter specifying a height to wrap for short loads (e.g., for loads that are shorter than a height sensor), etc.

In addition, in some embodiments the advanced parameters 670 may also include selection of a particular controlled wrap cycle interruption for use in customizing a wrap cycle to accommodate a specialized load requirement, as will be discussed in greater detail below.

A packaging material profile 660 may include a number of packaging material-related attributes and/or parameters, including, for example, an incremental containment force/revolution attribute 672 (which may be represented, for example, by a slope attribute and a force attribute at a specified wrap force), a weight attribute 674, a wrap force limit attribute 676, and a width attribute 678. In addition, a packaging material profile may include additional information such as manufacturer and/or model attributes 680, as well as a name attribute 682 that may be used to identify the profile. Other attributes, such as cost or price attributes, roll length attributes, prestretch attributes, or other attributes characterizing the packaging material, may also be included.

Each profile manager 654, 656 supports the selection and management of profiles in response to user input, e.g., from an operator of the wrapping apparatus. For example, each profile manager may receive user input 684, 686 to create a new profile, as well as user input 688, 690 to select a previously-created profile. Additional user input, e.g., to modify or delete a profile, duplicate a profile, etc. may also be supported. Furthermore, it will be appreciated that user input may be received in a number of manners consistent with the invention, e.g., via a touchscreen, via hard buttons, via a keyboard, via a graphical user interface, via a text user interface, via a computer or controller coupled to the wrapping apparatus over a wired or wireless network, etc.

In addition, wrap and packaging material profiles may be stored in a database or other suitable storage, and may be created using control system 650, imported from an external system, exported to an external system, retrieved from a storage device, etc. In some instances, for example, packaging material profiles may be provided by packaging material manufacturers or distributors, or by a repository of packaging material profiles, which may be local or remote to the wrapping apparatus. Alternatively, packaging material profiles may be generated via testing, e.g., as disclosed in U.S. Pub. No. 2012/0102886, which is assigned to the same assignee as the present application, and which is incorporated by reference herein in its entirety.

A load wrapping operation using control system 650 may be initiated, for example, upon selection of a wrap profile 658 and a packaging material profile 660, and results in initiation of a wrapping operation through control of a packaging material drive system 692, rotational drive system 694, and lift drive system 696.

Furthermore, wrap profile manager 654 includes functionality for automatically calculating one or more parameters in a wrap profile based upon a selected packaging material profile and/or one or more other wrap profile parameters. For example, wrap profile manager 654 may be configured to calculate a layer parameter and/or a wrap force parameter for a wrap profile based upon the load containment force requirement for the wrap profile and the packaging material attributes in a selected packaging material profile. In addition, in response to modification of a wrap profile parameter and/or selection of a different packaging material profile, wrap profile manager 654 may automatically update one or more wrap profile parameters.

In one embodiment, for example, selection of a different packaging material profile may result in updating of a layer and/or wrap force parameter for a selected wrap profile. In another embodiment, selection of a different wrap force parameter may result in updating of a layer parameter, and vice versa.

As one example, in response to unacceptable increases in film breaks, film quality issues, or mechanical issues such as film clamps or prestretch roller slippage, an operator may reduce wrap force (i.e., increase payout percentage), and functionality in the wrap control system may automatically increase the layer parameter to maintain the overall load containment force requirement for the wrap profile.

Further details regarding the configuration, modification and use of wrap profiles for use in some embodiments may be found, for example, in U.S. Pub. No. 2014/0223864, which is assigned to the same assignee as the present application, and which is incorporated by reference herein in its entirety. It will be appreciated, however, that other manners of creating, modifying and/or using wrap profiles may be used in other embodiments, so the invention is not limited to the particular operations disclosed herein and in the patents and publications incorporated by reference herein.

Moreover, it will be appreciated that while the wrap profiles discussed in connection with control system 650 are used in connection with containment force-based wrapping, where a minimum number of layers and a wrap force are defined to wrap a load to meet a load containment force requirement, in other embodiments, wrap profiles may be used in connection with other types of stretch wrapping technologies. In some embodiments, for example, wrap profiles may be used in connection with tension-based wrapping or demand-based wrapping, and may define a payout percentage or wrap tension to be used when wrapping. In such instances, a control system may be configured to maintain a substantially constant tension in a web of packaging material when wrapping a load, or alternatively, a dispense rate that is proportional to a sensed demand of the load (e.g., using an idle roller downstream of a packaging material dispenser). Further, in some embodiments a wrap profile may define a carriage speed or amount of overlap between successive layers of packaging material, rather than a minimum number of layers. Wrap profiles may in general be implemented in connection with practically any type of stretch wrapping technology, and thus, the invention is not limited to the particular stretch wrapping technologies discussed herein.

Furthermore, in some embodiments, separate wrap and packaging material profiles may not be used, and instead, one or more packaging material parameters may be incorporated into each wrap profile, thereby restricting wrap profiles to particular types of packaging material defined by the wrap profiles themselves. In still other embodiments, packaging material parameters may be stored independent of any profile.

Additional modifications will be apparent to those of ordinary skill having the benefit of the instant disclosure. Therefore, the invention is not limited to the particular embodiments discussed herein.

Wrap Profiles with Controlled Wrap Cycle Interruptions

As noted above, many types of wrapping operations are standard wrapping operations that wrap packaging material about a generally homogeneous, non-compressible load with a generally cuboid shape. Other loads, however, may have specialized load requirements that may not be fulfilled by standard wrapping operations. As an example, particularly in warehouses and distribution centers, pallets may be individually loaded with unique combinations of goods for delivery to specific locations, resulting in loads that have irregular shapes, and in some instances, may have incomplete top layers, where as little as a single article or box sits on top of the load. In such situations, a standard wrapping operation may not sufficiently wrap around the single article or box, and creating a risk that the article or box could separate from the load during shipping.

As another example, some loads may be relatively delicate and prone to damage during shipping, particularly along the corners, thereby requiring the installation of protective corner boards on the corners of the load. Some loads likewise may be exposed to environmental conditions such as rain, snow, humidity, etc., and it may be desirable to cover the top of the load with protective material.

It may also be desirable for some loads to only wrap in one direction (e.g., from bottom to top), rather than to wrap in both directions. In addition, for some loads, it may be desirable to build loads and wrap loads iteratively, e.g., by stacking each layer of a load individually and wrapping that layer prior to stacking the next layer of the load. Further, it may be desirable to secure multiple loads together, e.g., by stacking one palletized load on top of another palletized load, and then wrapping packaging material around both loads to secure the loads together.

In some instances, particularly on many automatic-type wrapping machines, dedicated machinery may be utilized to handle some of these types of specialized load requirements. In other instances, however, particularly on many semi-automatic-type wrapping machines, dedicated machinery may not be feasible and/or cost-effective, and manual operator involvement may be needed.

In various embodiments of the invention, controlled wrap cycle interruptions are supported in wrap profiles to modify standard wrapping operations to handle various types of specialized load requirements. As such, a wrap profile for a load may be created and/or stored in a wrap profile database, and may define one or more controlled wrap cycle interruptions such that when a wrap cycle is executed using the wrap profile, the controlled wrap cycle interruption(s) will be executed by a wrapping machine during the wrap cycle.

A controlled wrap cycle interruption, in this regard, may refer to one or more interruptions to a standard wrapping operation that cause deviation from the standard sequence of wrapping packaging material in a spiral manner around a load, generally starting and ending proximate the bottom of the load. A controlled wrap cycle interruption may also be associated in some embodiments with one or more manual operator activities to be performed during the wrapping operation, and in some embodiments, a controlled wrap cycle interruption may also be associated with one or more operator prompts that alert, and in some instances, provide guidance and/or instructions to an operator to facilitate performance of one or more manual operator activities. Controlled wrap cycle interruptions may also receive timely user input in some instances such that operator control of a wrapping machine may be prompted at appropriate times in a wrap cycle to customize a controlled wrap cycle interruption for a particular load (e.g., to move a roll carriage to an appropriate height on a load, to select a next step in a multi-step operation, etc.). Such input may be via a touch screen or other graphical or textual interface in some embodiments, while in some embodiments other types of input devices may be used for some types of inputs, e.g., the use of a joystick, knob, buttons, mouse, slider, etc. to move a carriage to a desired elevation.

Controlled wrap cycle interruptions may include various operations performed prior to completion of a wrap cycle, such as temporarily pausing or stopping a wrap cycle (e.g., by pausing or stopping relative rotation between the packaging material dispenser and a load support), temporarily changing (e.g., decreasing and/or increasing) a relative rotation speed between a packaging material dispenser and a load support, prematurely terminating a wrap cycle, temporarily changing (e.g., reducing and/or increasing) a dispense rate of a packaging material dispenser, moving the packaging material dispenser to a predetermined position or elevation (e.g., by raising or lowering a roll carriage), etc.

By including controlled wrap cycle interruptions in a wrap profile, a number of potential benefits may be realized. For example, particularly since wrap profiles may be created and stored for later use, an operator may not be required to recall which loads, if any, have specialized load requirements, what those specialized load requirements are, and/or what manual activities may be required to accommodate those specialized load requirements. Thus, by including a wrap cycle interruption in a wrap profile, the specialized load requirements may be accommodated without the operator who is wrapping a load having to remember that the load has such requirements, or to specifically control a wrapping machine to accommodate such requirements (e.g., by manually stopping the wrapping machine to perform various manual operator activities). In addition, greater repeatability and consistency generally may be achieved from load to load through the inclusion of controlled wrap cycle interruptions. Moreover, in some instances, where an operator is unfamiliar with a wrapping machine or how to accommodate a specialized load requirement, the operator may be prompted and/or guided by a wrapping machine to do so. Furthermore, by supporting multiple types of controlled wrap cycle interruptions, a wrapping machine may be capable of supporting a wide variety of stretch wrapping needs for an organization, as a wrapping machine may be capable of handling a wider variety of loads.

Figure 7:
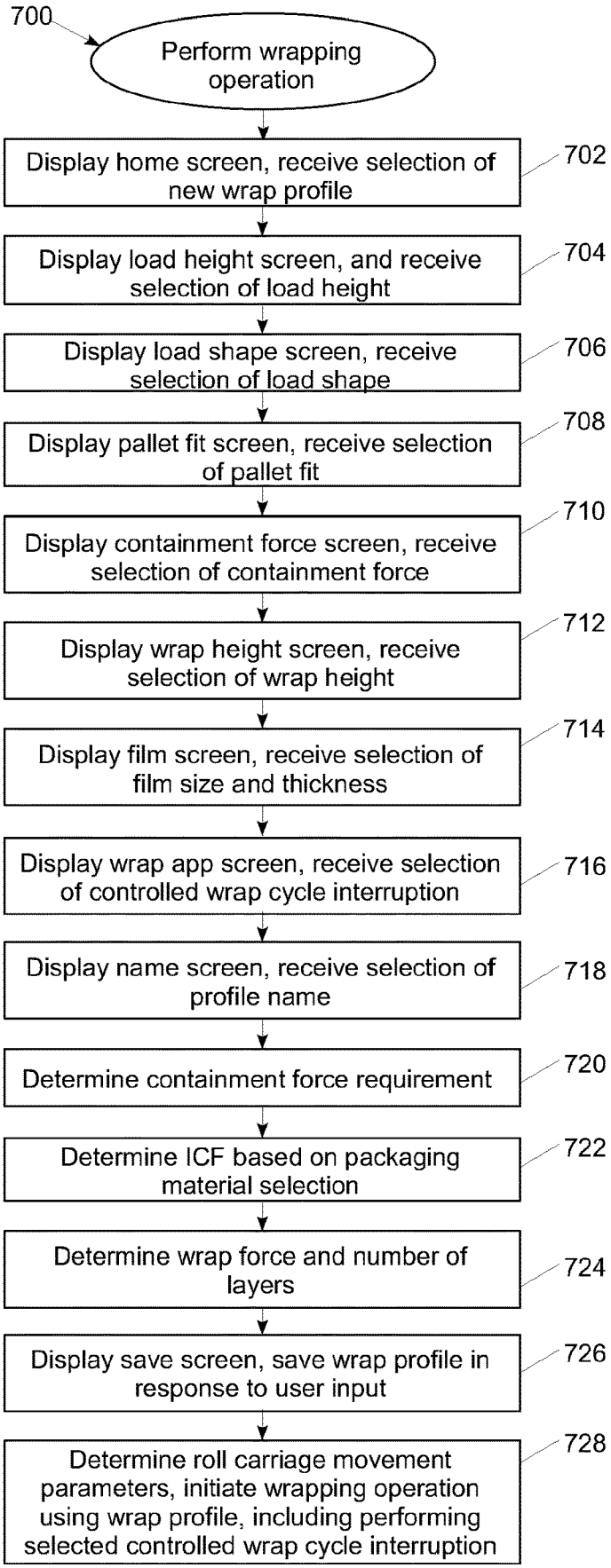
FIG. 7 is a flowchart illustrating a sequence of steps in an example routine for configuring a wrap profile and performing a wrapping operation using the control system of FIG. 6.

Now turning to FIG. 7, and with further reference to FIGS. 8A-8J, FIG. 7 illustrates an example routine 700 for performing a wrapping operation consistent with some embodiments of the invention, while FIGS. 8A-8J illustrate a number of example touch screen displays that may be presented to an operator in connection with performing routine 700. In the example presented, some wrap parameters are entered by an operator over the course of a plurality of screens, while other wrap parameters may be derived from the wrap parameters entered by an operator via the plurality of screens. In other embodiments, however, different displays or user input sequences may be used to create a wrap profile, so the invention is not limited to the particular user interface disclosed herein.

Figure 8A:
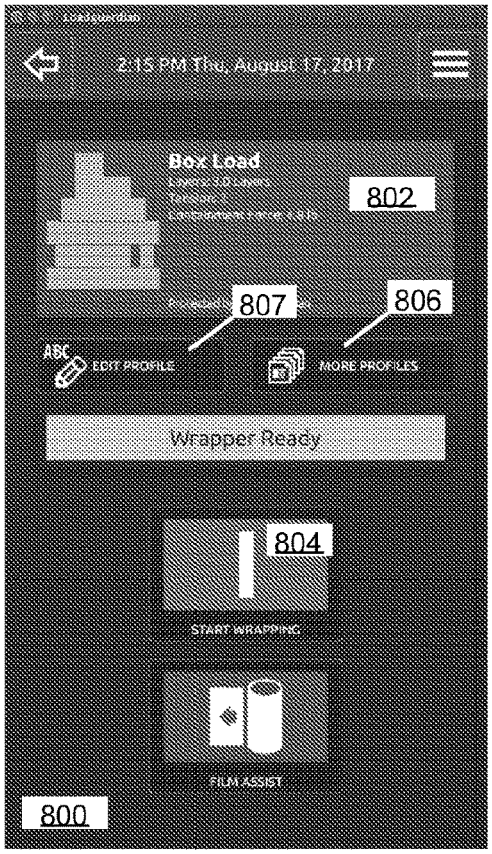
FIGS. 8A-8J are block diagrams of example displays capable of being displayed by the control system of FIG. 6 when configuring a wrap profile using the sequence of steps of FIG. 7.

First, in block 702, a home screen displayed and an operator selects an option to create a new wrap profile. FIG. 8A, for example, illustrates an example computer-generated screen 800 that may be displayed to an operator during normal operation of a wrapping apparatus, generally on a user interface such as a touch-sensitive display for the wrapping apparatus, although it will also be appreciated that an external device such as a mobile computing device may utilize a similar process in order to create a new wrap profile. A panel 802 displays a selected wrap profile, including various wrap parameters associated therewith, while a start button 804 is provided to start a wrap cycle. Additional information and/or controls, e.g., forward/back buttons, home buttons, menu buttons, time/date information, machine status information, packaging material configuration controls ("Film Assist"), etc. may also be displayed as appropriate. In addition, wrap profile buttons 806, 807 may also be displayed, with button 806 used to manage wrap profiles, e.g., to create, select, modify or delete wrap profiles, and button 807 used to edit the current wrap profile. For the purposes of block 702 of FIG. 7, it may be assumed that an operator selects button 806 to manage wrap profiles, and then selects a "new profile" option on a wrap profile management display (not shown). Alternatively, a new profile control may be displayed on display 800 in some embodiments, and regardless, it will be appreciated that editing a wrap profile (e.g., in response to selection of button 807) may proceed in a similar manner to creating a new wrap profile, only with existing wrap parameters displayed on the various screens provided for creating a wrap profile.

Figure 8B:
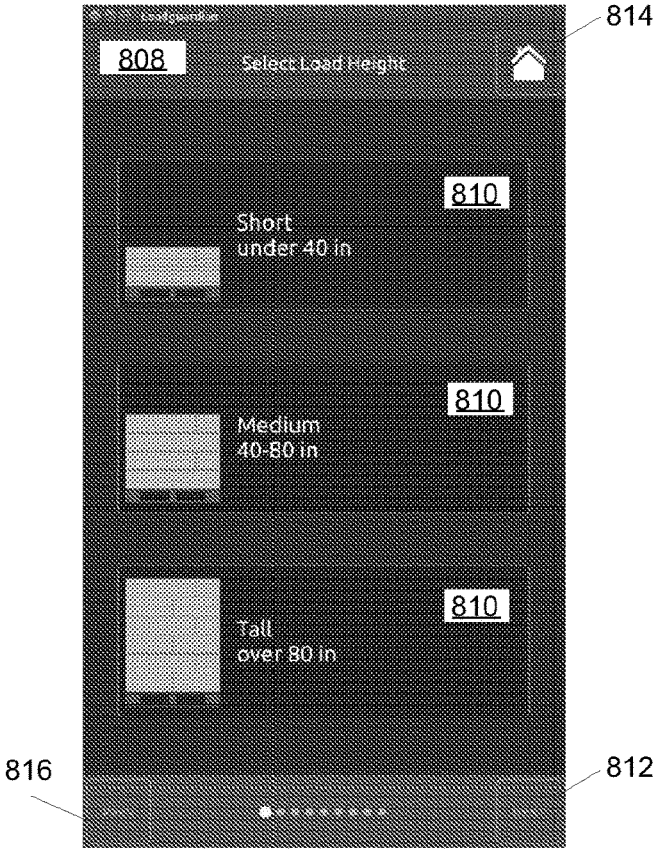

Returning to FIG. 7, once a new wrap profile selection is made, a load height screen is displayed and a selection of load height is made by an operator (block 704). FIG. 8B, for example, illustrates an example load height screen 808, including three height selection buttons 810 for selecting from between three ranges of heights for the load to be wrapped (short, medium, tall). In other embodiments, specific heights or different ranges of heights may be used. Screen 808 also illustrates a next button 812 that may be selected once a height button 810 has been selected to proceed to the next step in the wrap profile creation process, as well as a home button 814 and a back button 816 that may be used to return to the start of the wrap creation process or to the prior screen, respectively.

Figure 8C:
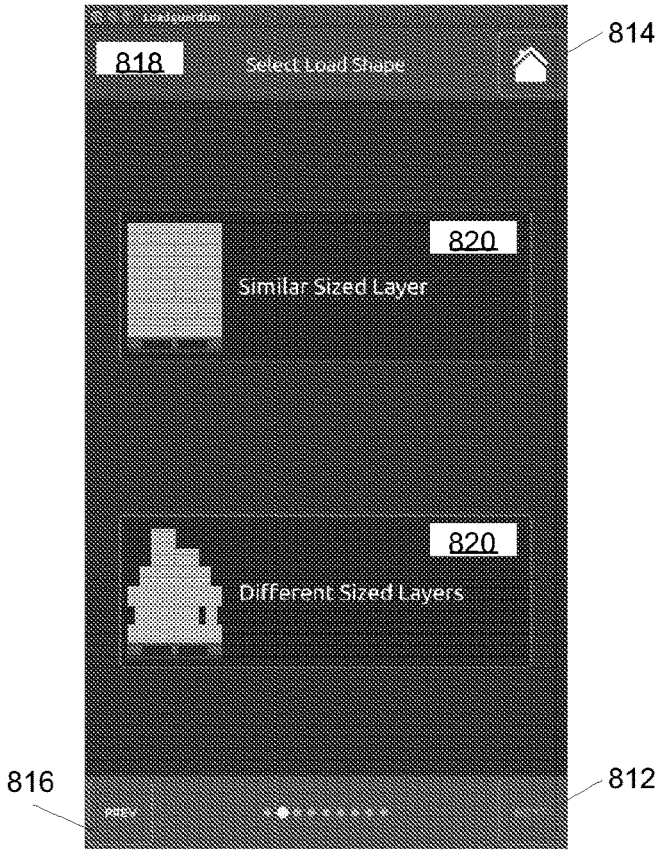

Returning again to FIG. 7, once load height is selected, a load shape screen is displayed and a selection of load shape is made by an operator (block 706). FIG. 8C, for example, illustrates an example load shape screen 818, including a pair of load shape buttons 820 that distinguish from a load having similar sized layers and a load having different sized layers.

Figure 8D:
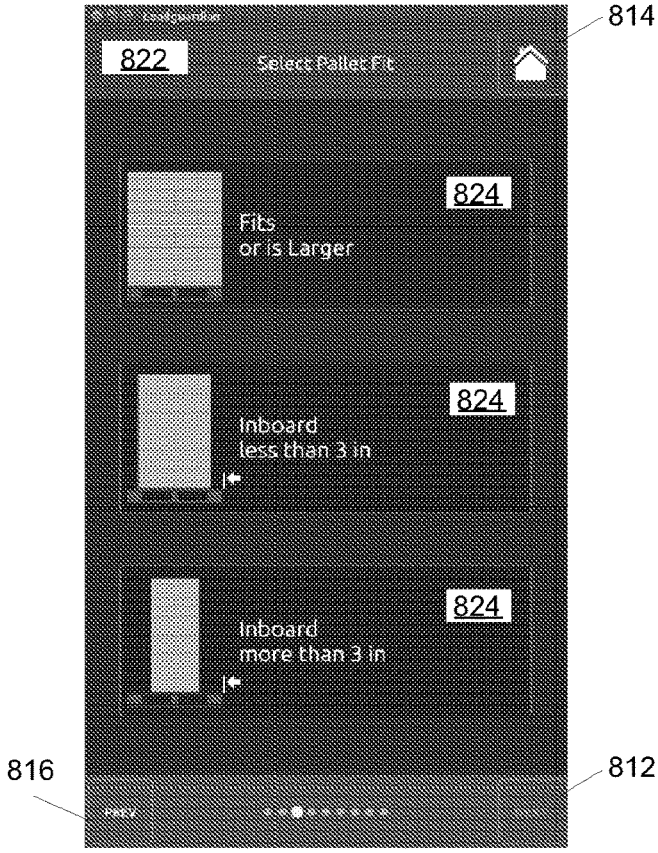

Returning yet again to FIG. 7, once load shape is selected, a pallet fit screen is displayed and a selection of pallet fit is made by an operator (block 708). FIG. 8D, for example, illustrates an example pallet fit screen 822, including a set of pallet fit buttons 824 that distinguish from a load having being of the same or a larger size than its pallet, a load being somewhat inboard of the pallet (e.g., less than 3 inches), or a load being extremely inboard of the pallet (e.g., more than 3 inches).

Figure 8E:
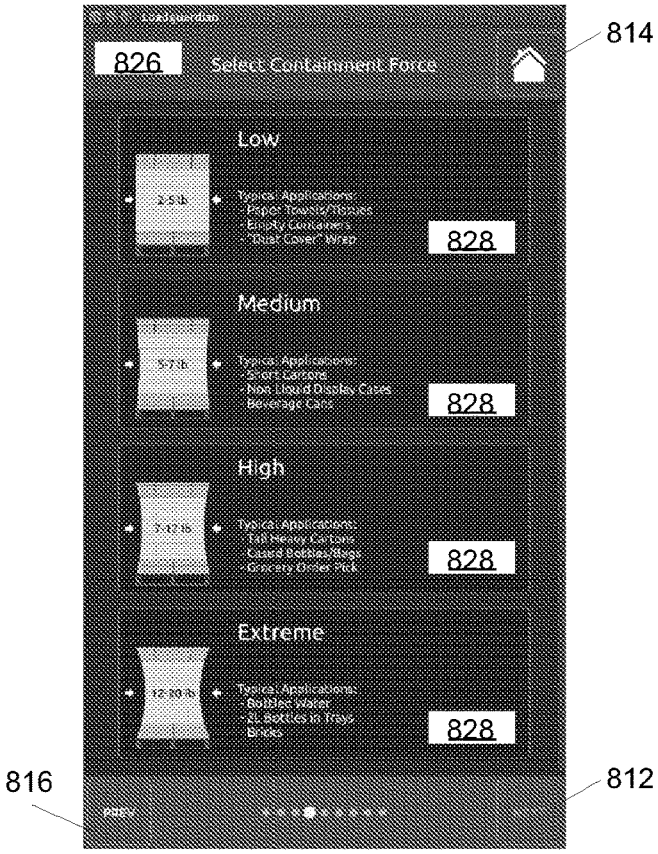

Once again returning to FIG. 7, once pallet fit is selected, a containment force screen is displayed and a selection of containment force is made by an operator (block 710). FIG. 8E, for example, illustrates an example containment force screen 826, including a set of containment force buttons 828 that distinguish between different containment force ranges for a load. As illustrated in the figure, descriptive information regarding types of loads corresponding to each containment force range may also be presented to enable an operator to make an educated selection of one of buttons 828, thereby selecting between low (2-5 lb), medium (5-7 lb), high (7-12 lb) and extreme (12-20 lb) containment force ranges for use in wrapping the load.

Figure 8F:
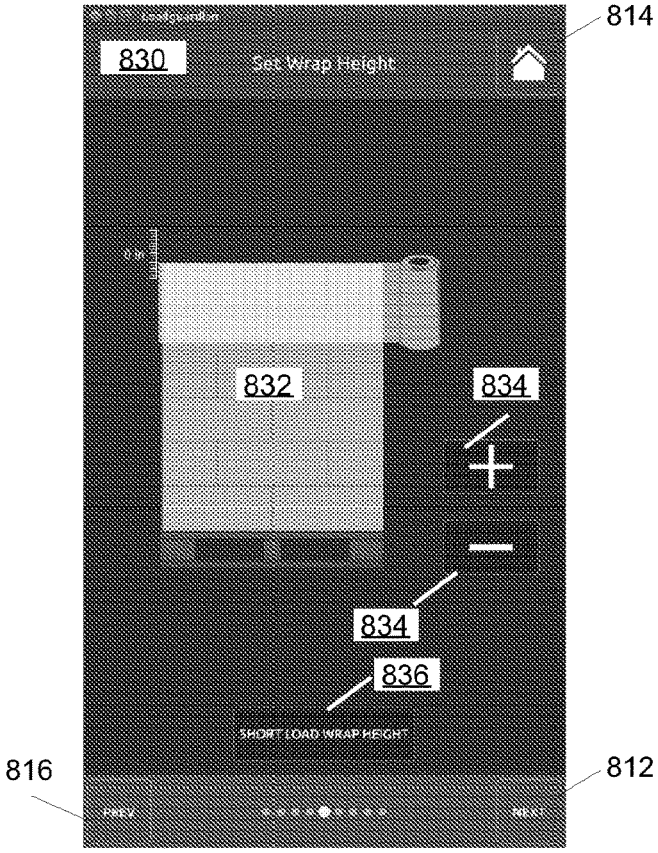

Next, as shown in block 712 of FIG. 7, a wrap height screen may be displayed and a selection of wrap height received from an operator. FIG. 8F, for example, illustrates an example wrap height screen 830, including a graphical representation 832 of a load and plus/minus buttons 834 to increase or decrease the among of overwrap (i.e., the amount of packaging material that extends above a top of the load). In addition, in some embodiments a short load wrap height button 836 may be presented to enable an operator to specify a wrap height for shorter loads, i.e., loads that are too short to trigger automatic load height detection.

Figure 8G:
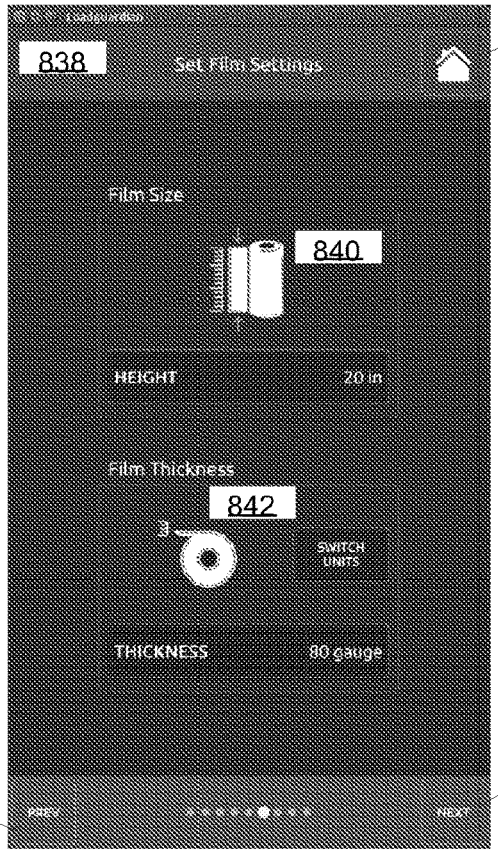

Next, as shown in block 714 of FIG. 7, a film or packaging material screen may be displayed and a selection of one or more packaging material parameters may be made. FIG. 8G, for example, illustrates an example film screen 838 including controls 840, 842 for respectively setting film size or height and film thickness. As such, it will be appreciated that in this embodiment separate packaging material profiles are not used, and packaging material parameters are incorporated directly into wrap profiles. In other embodiments, however, separate packaging material profiles may be used, and as such, screen 838 may be omitted.

Figure 8H:
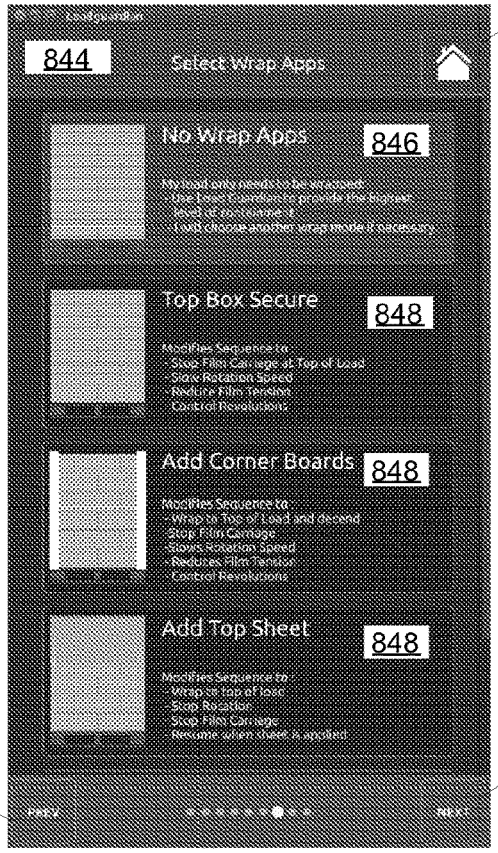

Next, as shown in block 716 of FIG. 7, a wrap app screen may be displayed and a selection of a "wrap app" may be made by an operator. A "wrap app" in this regard may correspond to a controlled wrap cycle interruption, as the selection of a controlled wrap cycle interruption may in some embodiments be conceptualized as being similar to selection of an application on a mobile computing device. As shown in FIG. 8H, for example, one example wrap app screen 844 may include a "no wrap apps" button 846 and a set of buttons 848 permitting an operator to select either a standard wrapping operation with no wrap apps via button 846 or one of a plurality of wrap apps (controlled wrap cycle interruptions) via one of buttons 848. Each button 846, 848 may additionally include descriptive information in order to facilitate operator selection of a controlled wrap cycle interruption appropriate to any specialized requirements for a load.

Figure 8I:
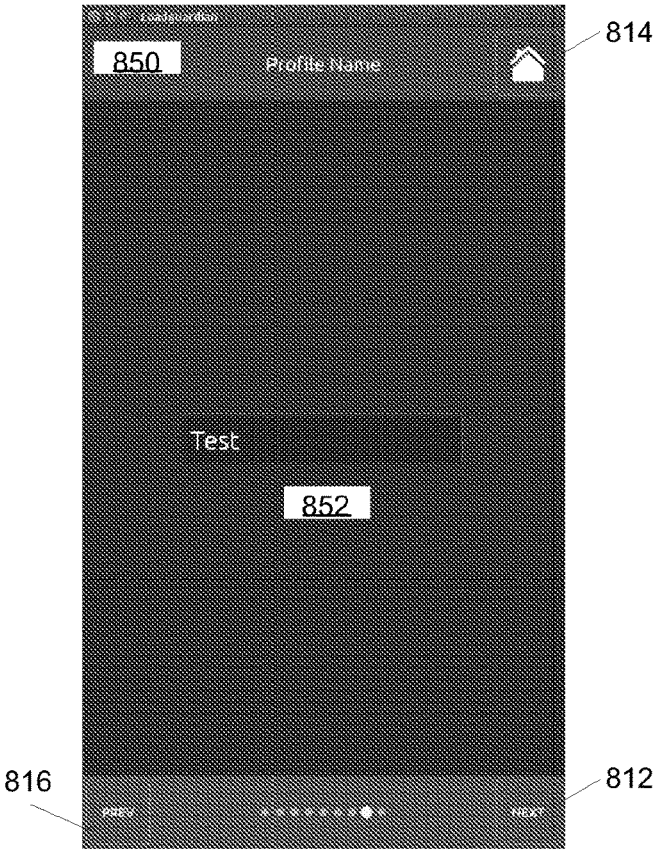
Figure 8J:
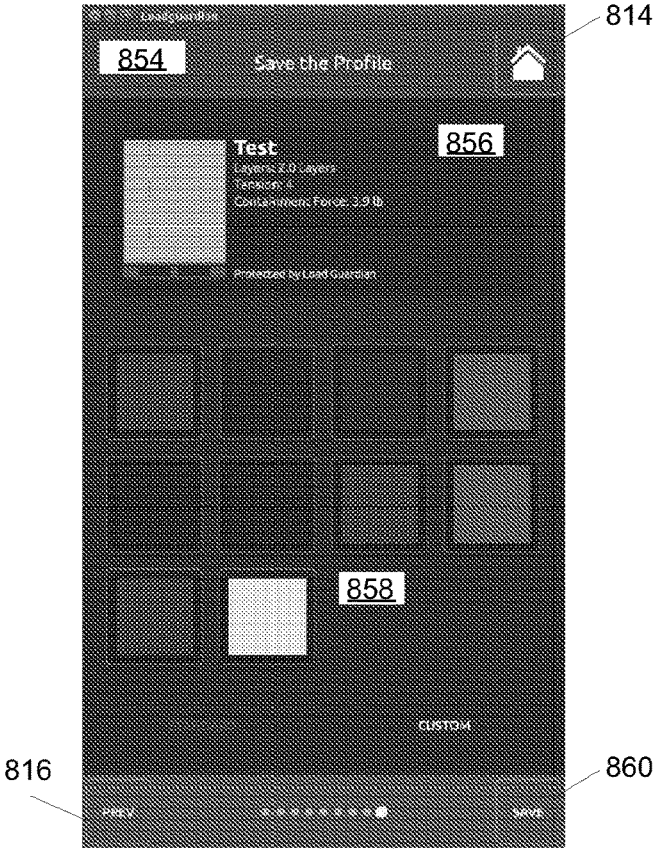

Next, as shown in block 718 of FIG. 7, a name screen may be displayed and a selection of a profile name may be made by an operator. FIG. 8I, for example, illustrates an example name screen 850 including a text box 852 through which a profile name may be entered (e.g., via a pop-up keyboard).

Returning again to FIG. 7, in blocks 720-724 one or more additional wrap parameters may be determined from the wrap parameters entered by the operator in the prior screens. For example, in some embodiments, and as illustrated in block 720, a load containment force requirement may be determined, e.g., based upon the wrap parameters entered in blocks 704-710. Next, an incremental containment force (ICF) may be determined based on the size and thickness of the packaging material entered in block 714 and the wrap force and number of layers for achieving the desired containment force requirement may be determined in block 724. Determination of an ICF may be made based on packaging material width and thickness in any of the manners discussed above or in the references incorporated by reference herein, e.g., based on a table or a function that maps ICF to packaging material attributes or parameters. In some embodiments, an ICF function may be linear, and based on an ICF value at a predetermined wrap force (e.g., 100% payout) and a slope. Alternatively, a more complex ICF function may be defined, e.g., based on an s-curve, interpolation, piecewise linear, exponential, multi-order polynomial, logarithmic, moving average, power, or other regression or curve fitting technique. In some embodiments, an ICF function may be defined for different load stability types based on a default packaging material thickness and a slope that varies the ICF for different thicknesses, such that an ICF value may be determined based upon the thickness specified in block 714.

Determination of wrap force and number of layers may also be performed in any of the manners discussed above or in the aforementioned references, based in part on the load containment force requirement and the ICF determined for the current packaging material. For example, it may be desirable to associate a default number of layers for a given load stability type and adjust wrap force to meet the desired containment force requirement using the determined ICF. Limits (e.g., maximum allowable wrap force) may be checked once a wrap force is calculated, and one or more layers may be added or removed as is desired to obtain an acceptable wrap force.

In addition, in some embodiments, each load stability type may have a default number of layers and wrap force, as well as a default packaging material thickness that, when combined with the default number of layers and wrap force, is anticipated to meet a load containment force requirement for loads of that load stability type. Then, the layers/wrap force may be adjusted for the actual thickness of the packaging material that the wrap profile is being set up for, e.g., by adjusting wrap force first, and modifying the default layers only when no acceptable wrap force can be established for that containment force requirement and packaging material thickness.

In addition, in some embodiments, each containment force range selected in block 710 may be associated with a different load stability type and used to set a range of containment forces, and then, based upon load height (block 704), load shape (block 706) and pallet fit (block 708), a specific containment force requirement and associated wrap force and minimum number of layers may be determined, as taller loads may have a higher containment force requirement than shorter loads due to their relatively lower stability, and as loads with different sized layers and/or that are inboard of a pallet may be at greater risk of film breaks due to their irregular shapes and may have limits on wrap force, necessitating additional layers but at a reduced wrap force in order to meet a load containment force requirement.

Returning yet again to FIG. 7, once the additional wrap parameters are determined in blocks 720-724, block 726 displays a save screen and saves or stores the wrap profile in response to user input. An example save screen is illustrated at 854 in FIG. 8J, including a panel 856 displaying information regarding the wrap profile to be saved, and optionally including a color selection control 858 from which an operator may select a particular color to associate with the wrap profile. A save button 860 replaces the next button 812, such that operator selection of the save button stores the wrap profile. The wrap profile, as noted above, may be stored in a wrap profile database, e.g., on the load wrapping apparatus, on a mobile device, on a server, in the cloud, or in another other suitable repository. In addition, it will be appreciated that a wrap profile database may include any type of data store for wrap profiles, and in some instances may not be limited to storing only wrap profiles (e.g., in the case of a general purpose database that stores additional load wrapping apparatus information).

Next, as illustrated by block 728 of FIG. 7, once the wrap profile has been saved, a load may be wrapped using the wrap profile. In particular, upon selection of a start button or other appropriate control (e.g., button 804 of FIG. 8A), roll carriage movement parameters may be determined, e.g., by determining a speed or rate of the roll carriage during a wrapping operation, as the number of layers applied by a wrapping operation may be controlled in part by controlling the speed or rate of the roll carriage as it travels between top and bottom positions relative to the rotational speed of the load. The rate may further be controlled based on a desired overlap between successive revolutions or wraps of the packaging material and/or the number of up and/or down passes of the roll carriage.

In addition, in block 728 a wrapping operation is performed using the wrap profile, including performing any controlled wrap cycle interruption specified by the wrap profile, and routine 700 is complete.

As noted above, various operations may be utilized as controlled wrap cycle interruptions in various embodiments, and different combinations of such interruptions may be supported in different embodiments. FIGS. 9-14 illustrate five example controlled wrap cycle interruptions, although the invention is not limited to this combination of interruptions.

Figure 9:
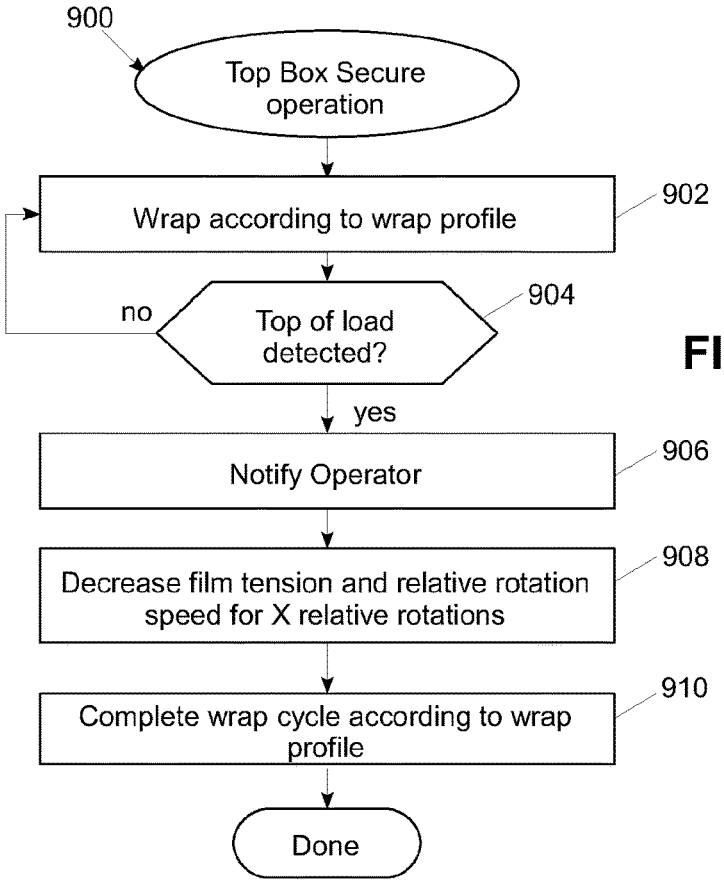
FIG. 9 is a flowchart illustrating a sequence of steps in an example routine for performing a top box secure operation using the control system of FIG. 6.

FIG. 9, for example, illustrates a type of controlled wrap cycle interruption referred to as a top box secure operation 900. As noted above, particularly in warehouses and distribution centers, some pallets may be individually loaded with unique combinations of goods for delivery to specific locations, resulting in loads that have irregular shapes, and in some instances, may have incomplete top layers, where as little as a single article or box sits on top of the load. In such situations, a standard wrapping operation may not sufficiently wrap around the single article or box, and creating a risk that the article or box could separate from the load during shipping. A top box secure operation may therefore be used to handle this specialized load requirement. With such an operation, standard wrapping is performed according to the wrap parameters in the wrap profile as shown in block 902 until the top of the load is detected in block 904, such that packaging material is wrapped at a normal speed from the bottom to the top of the load. Once the top of the load is detected (e.g., via a sensor on the packaging material dispenser or roll carriage), block 904 passes control to block 906 to optionally notify the operator (e.g., via audio and/or visual messages) and then control passes to block 908 to temporarily increase the dispense rate to effectively reduce the tension in the web of packaging material and to reduce the relative rotation speed for one or more (X) relative rotations between the packaging material dispenser and the load support. This allows the operator to manually manipulate the web of packaging material (e.g., by raising the web to avoid some of the corners of the main body of the load) to secure the top box, article or incomplete layer on the top layer of the main body of the load. As such, block 906 may provide an operator with guidance on how to manipulate the web of packaging material to secure the incomplete layer or box. Then, once the predetermined number of relative revolutions have been completed, block 910 returns the film tension and relative rotation speed return to the parameters specified by the wrap profile and the wrap cycle completes.

Figure 10:
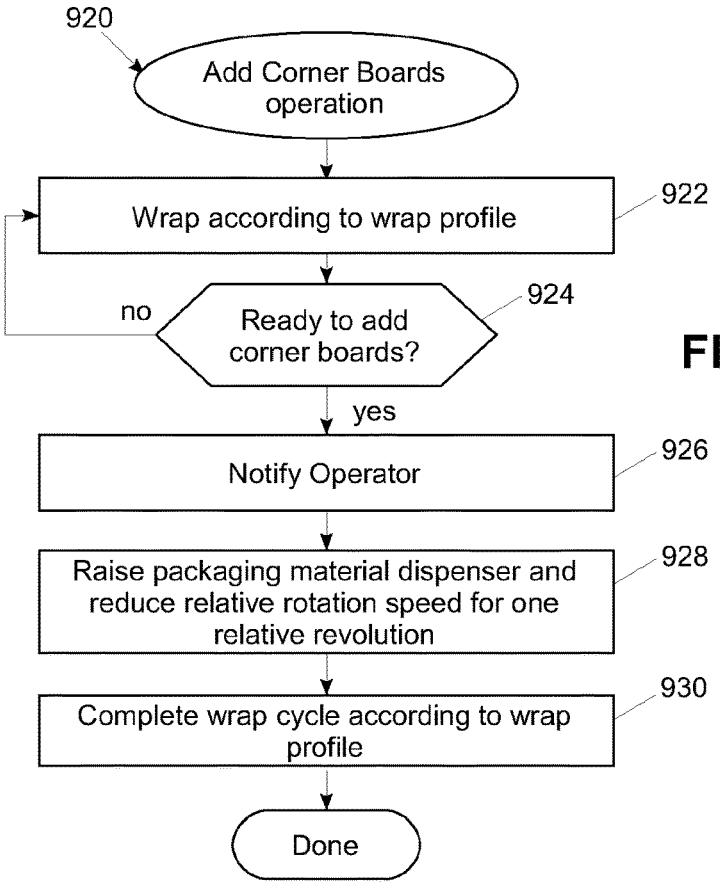
FIG. 10 is a flowchart illustrating a sequence of steps in an example routine for performing an add corner boards operation using the control system of FIG. 6.

FIG. 10 next illustrates another type of controlled wrap cycle interruption referred to as an add corner boards operation 920. As noted above, some loads may be relatively delicate and prone to damage during shipping, particularly along the corners, thereby requiring the installation of protective corner boards on the corners of the load. As such, after a wrap cycle is started, standard wrapping is performed according to the wrap parameters in the wrap profile as shown in block 922 until an appropriate time in the wrap cycle when it is desirable to begin the controlled intervention, which is detected in block 924. For example, initial wrapping may be performed to secure the bottom of the load to the pallet.

Once block 924 determines it is time to add the corner boards, control passes to block 926 to optionally notify the operator, and optionally to provide guidance to the operator on how to add the corner boards. Block 928 then raises the roll carriage or packaging material dispenser a predetermined amount (e.g., about 15 inches) to position the dispenser at a predetermined elevation and holds it at that elevation for one revolution. In addition, the relative rotation speed is reduced for that revolution to give additional time for the operator to manually insert a corner board as each corner revolves past the operator. After the revolution, control passes to block 930 to increase the relative rotation speed and complete the wrap cycle according to the wrap profile.

Figure 11:
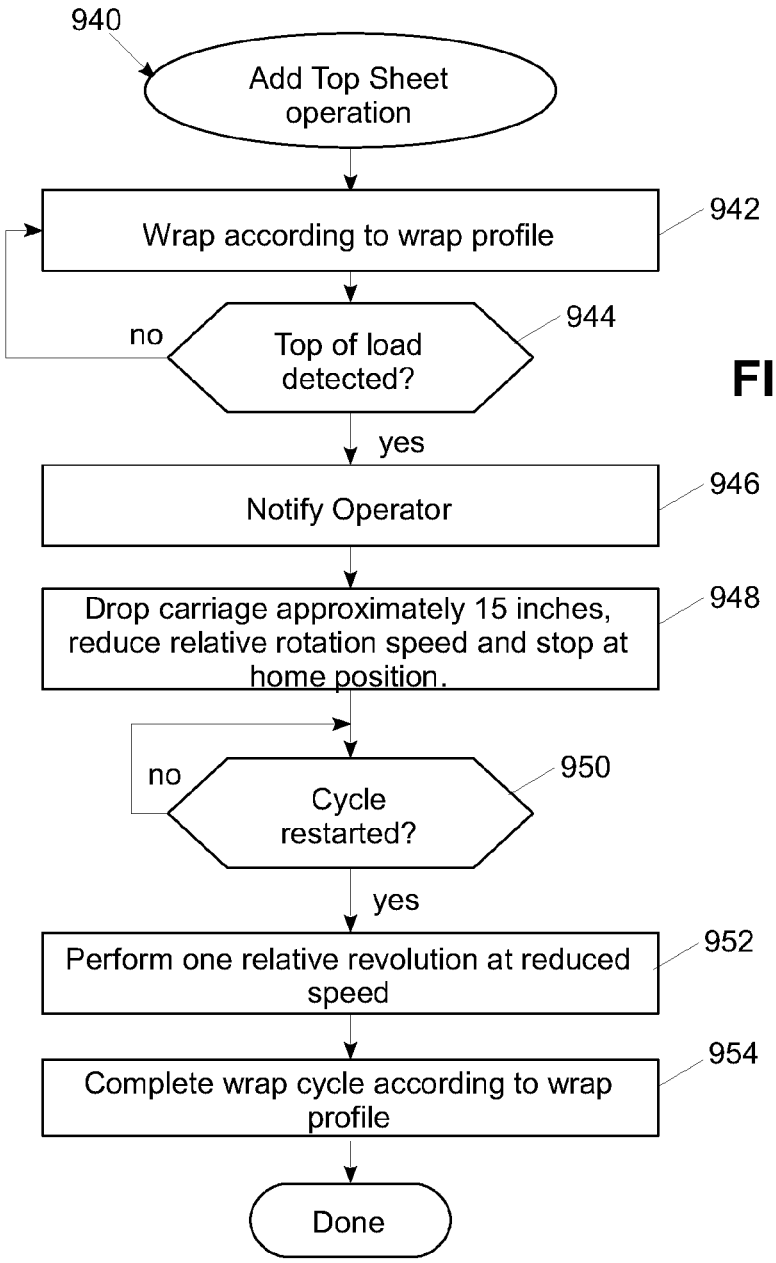
FIG. 11 is a flowchart illustrating a sequence of steps in an example routine for performing an add top sheet operation using the control system of FIG. 6.

FIG. 11 next illustrates another type of controlled wrap cycle interruption referred to as an add top sheet operation 940. As noted above, some loads may be exposed to environmental conditions such as rain, snow, humidity, etc., and it may be desirable to cover the top of the load with protective sheet of material. As such, after a wrap cycle is started, standard wrapping is performed according to the wrap parameters in the wrap profile as shown in block 942 until the top of the load is detected in block 944. Once the top of the load is detected, control passes to block 946 to optionally notify the operator, and optionally to provide guidance to the operator on how to add the top sheet. Block 948 then lowers the packaging material dispenser to a predetermined elevation (e.g., about 15 inches from the detected top of load), reduces the relative rotation speed and then stops the relative rotation at a home position, thereby pausing the wrap cycle to enable the operator to manually place a top sheet over the load. Block 950 waits until the wrap cycle has been restarted by the operator (e.g., by touching a button on the touch-sensitive display), and once restarted, control passes to block 952 and wrapping resumes, e.g., by performing one or more relative revolutions at a reduced speed to reduce the risk of dislodging the top sheet, and then completing the wrap cycle according to the wrap profile in block 954, increasing the elevation of the packaging material dispenser until the top of the load is detected and thereafter continuing with the wrap cycle as per a standard wrapping operation.

Figure 12:
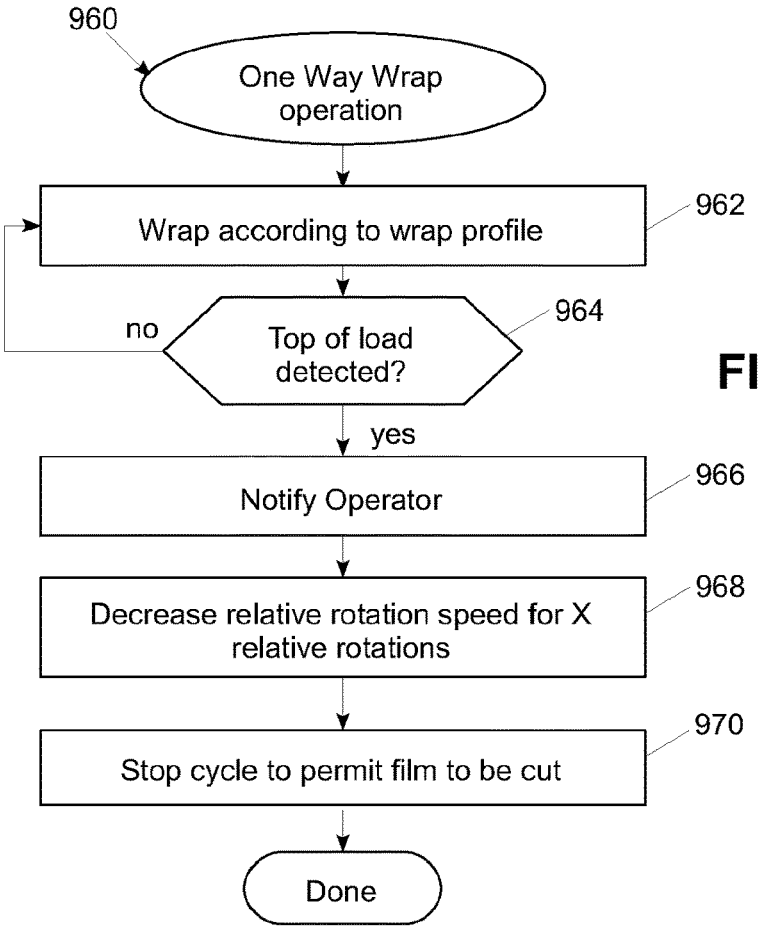
FIG. 12 is a flowchart illustrating a sequence of steps in an example routine for performing a one way wrap operation using the control system of FIG. 6.

FIG. 12 illustrates yet another type of controlled wrap cycle interruption referred to as a one way wrap operation 960, whereby wrapping occurs in only a single direction and pass between the bottom and top of a load. With such an operation, standard wrapping is performed according to the wrap parameters in the wrap profile as shown in block 962 until the top of the load is detected in block 964, such that packaging material is wrapped at a normal speed from the bottom to the top of the load. Once the top of the load is detected (e.g., via a sensor on the packaging material dispenser or roll carriage), block 964 passes control to block 966 to optionally notify the operator (e.g., via audio and/or visual messages) and then control passes to block 968 to temporarily reduce the relative rotation speed for one or more (X) relative rotations between the packaging material dispenser and the load support. The wrap cycle is then stopped in block 970 to allow an operator to manually cut the packaging material. As such, block 966 may provide an operator with instructions to cut the packaging material when the relative rotation stops.

In some embodiments, once the packaging material is cut an operator may touch a control on the touch-sensitive display to return the packaging material dispenser to a home position proximate the load support for the start of the next wrap cycle. In other embodiments, however, wrap cycles may alternate between bottom to top and top to bottom wrap cycles, whereby an operator may simply attach the packaging material to the next load at the completion of a wrap cycle and start the next wrap cycle, with wrapping occurring in an opposite direction from the prior wrap cycle.

Figure 13:
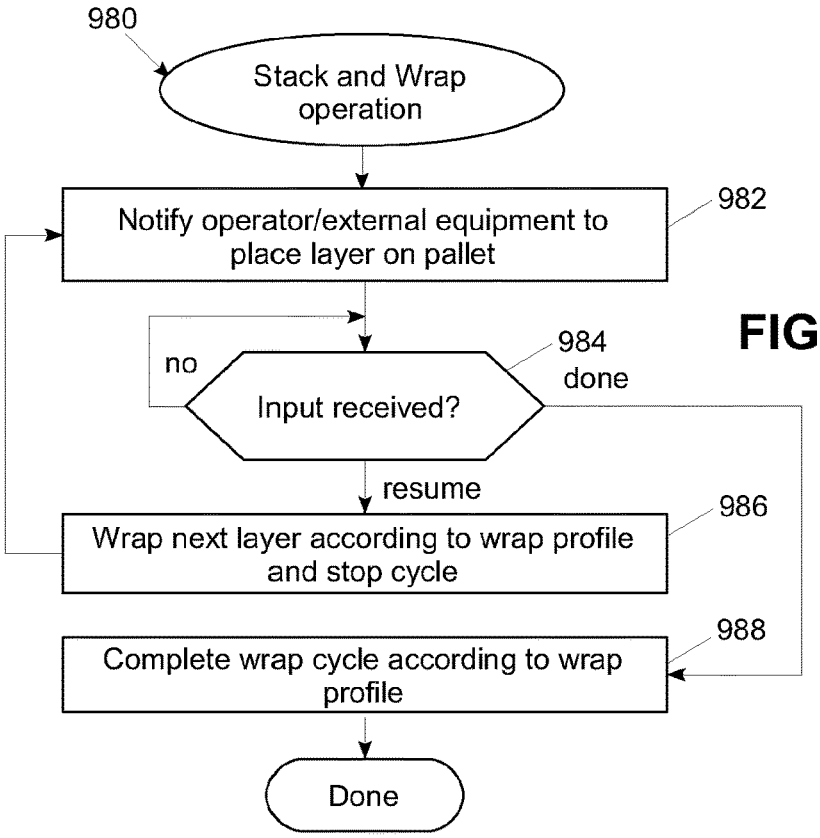
FIG. 13 is a flowchart illustrating a sequence of steps in an example routine for performing a stack and wrap operation using the control system of FIG. 6.

FIG. 13 next illustrates a type of controlled wrap cycle interruption referred to as a stack and wrap operation 980. In particular, for some loads, it may be desirable to build loads and wrap loads iteratively, e.g., by stacking each layer of a load individually and wrapping that layer prior to stacking the next layer of the load. Thus, upon starting a wrap cycle with this interruption selected, the operator is notified in block 982 to place a full layer of articles or boxes on a pallet. Block 984 then waits until input is received from the operator, e.g., via the touch-sensitive display. If the input is to resume wrapping, control passes to block 986 to wrap the next layer on the pallet according to the wrap parameters in the wrap profile and then stop or pause the wrap cycle at a home position of relative rotation once the layer is wrapped. In some embodiments, the height of each layer may be known on stored in the wrap profile, while in other embodiments the top of the load may automatically be detected for each layer. Control then returns to block 982 to notify the operator to place another layer on the pallet. The sequence of blocks 982-986 may be repeated for each layer added to the pallet, and once all layers have been added, the operator may signal completion of the operation, and block 984 may pass control to block 988 to complete the wrap cycle according to the wrap parameters in the wrap profile, whereby the wrap cycle is complete. In some embodiments, the completion of the operation may also be signaled by reaching a maximum height or elevation for the machine.

It will be appreciated that a stack and wrap operation may also be used in connection with external machines, e.g., palletizers or robots, to place each layer on the pallet rather than by an operator. Thus, the notification in block 982 may in some instances be a control signal communicated to the external machine to cause the external machine to place another layer of articles on the pallet. In addition, it will also be appreciated that in some embodiments, stabilizers may also be added in connection with a stack and wrap operation.

Figure 14:
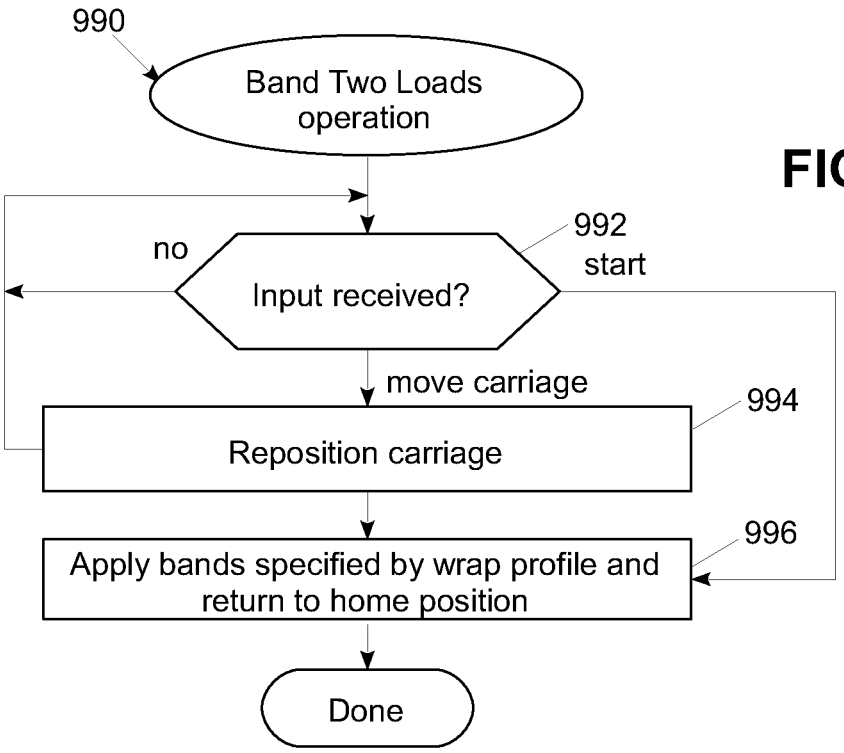
FIG. 14 is a flowchart illustrating a sequence of steps in an example routine for performing a band two loads operation using the control system of FIG. 6.

FIG. 14 next illustrates a type of controlled wrap cycle interruption referred to as a band two loads operation 990. In particular, it may be desirable for some loads to secure multiple loads together, e.g., by stacking one palletized load on top of another palletized load, and then wrapping packaging material around both loads to secure the loads together, including in some instances wrapping packaging material in bands around the interface between the two loads rather than fully wrapping both loads. In some instances, one or both loads may be separately wrapped in different cycles, or one load may be wrapped in the same cycle in which a band two loads operation is performed. For this operation, once both loads are stacked on the load support, an operator may manually jog the packaging material dispenser or roll carriage to an appropriate height corresponding to where the two loads will be joined, i.e., proximate a top of the bottom load. Thus, block 992 receives input from the operator, and when the input is associated with moving the roll carriage, control passes to block 994 to reposition the roll carriage accordingly. Then, if input is received to start the wrap cycle, block 992 passes control to block 996 to apply one or more bands specified by the wrap profile around an upper portion of the bottom load and a lower portion of the top load to secure the two loads together. In some embodiments, the packaging material web may also be narrowed, e.g., using a roping or rolling mechanism, when applying a band. The wrap cycle stops and the packaging material dispenser returns to the home position ready for the next load, whereby the wrap cycle is complete.

Other controlled wrap cycle interventions may be implemented in other embodiments to accommodate other specialized load requirements, as will be appreciated by those of ordinary skill having the benefit of the instant disclosure. In addition, various additional specialized wrapping operations may also be supported in some embodiments, e.g., band two loads operations where the elevation of the band is controlled via user input of a height of the bottom load, a short load operation where an input height of the load is used to control the wrap operation instead of sensing the height with a height sensor, a dust cover operation where a load is quickly wrapped with a low wrap force to provide a dust cover to a load not needing any supplemental containment, or a produce operation where a roping mechanism is used to reduce the width of a web of packaging material (by roping the top and/or bottom edges) and the narrowed width of the web and an input layer height is used to apply bands across the layer boundaries between layers of the load, among others.

Other embodiments will be apparent to those skilled in the art from consideration of the specification and practice of the present invention. It is intended that the specification and examples be considered as exemplary only, with a true scope and spirit of the disclosure being indicated by the following claims.

What is claimed is:

1. A method of controlling a load wrapping apparatus of the type configured to wrap a load on a load support with packaging material dispensed from a packaging material dispenser through relative rotation between the packaging material dispenser and the load support, the method comprising:

receiving input data selecting a wrap profile from among a plurality of wrap profiles for the load wrapping apparatus, wherein each of the plurality of wrap profiles includes a plurality of wrapping parameters that control operation of the load wrapping apparatus when wrapping, and wherein the selected wrap profile includes a wrapping parameter among the plurality of wrapping parameters that identifies a controlled wrap cycle interruption to be performed when wrapping the load; and performing a wrap cycle using the selected wrap profile to wrap the load with packaging material, including performing the controlled wrap cycle interruption during the wrap cycle;

wherein the load wrapping apparatus is configured to perform a standard wrapping operation that wraps packaging material in a spiral manner around a load starting and ending proximate a bottom of the load, wherein the controlled wrap cycle interruption deviates from the standard wrapping operation, and wherein the method further comprises:

receiving an additional input data selecting an additional wrap profile from among the plurality of wrap profiles that does not identify any controlled wrap cycle interruption to be performed when wrapping the load; and performing an additional wrap cycle using the additional wrap profile to wrap an additonal load with packaging material using the standard wrapping operation.

2. The method of claim 1, wherein the controlled wrap cycle interruption temporarily pauses or stops relative rotation between the packaging material dispenser and the load support prior to completion of the wrap cycle.

3. The method of claim 1, wherein the controlled wrap cycle interruption temporarily decreases a relative rotation speed between the packaging material dispenser and the load support prior to completion of the wrap cycle.

4. The method of claim 1, wherein the controlled wrap cycle interruption prematurely terminates the wrap cycle prior to completion of the wrap cycle.

5. The method of claim 1, wherein the controlled wrap cycle interruption temporarily changes a dispense rate of the packaging material dispenser prior to completion of the wrap cycle.

6. The method of claim 1, wherein the packaging material dispenser is configured for movement between a plurality of positions along a direction parallel to an axis about which packaging material is wrapped around the load when the load is disposed on the load support, and wherein the controlled wrap cycle interruption moves the packaging material dispenser to a selected position among the plurality of positions prior to completion of the wrap cycle.

7. The method of claim 1, wherein performing the controlled wrap cycle interruption includes notifying an operator.

8. The method of claim 7, wherein notifying the operator includes displaying an alert to the operator on a display of the load wrapping apparatus.

9. The method of claim 8, wherein notifying the operator includes displaying one or more instructions to the operator to prompt the operator to perform a manual activity associated with the controlled wrap cycle interruption.

10. The method of claim 1, wherein the controlled wrap cycle interruption includes a top box secure operation.

11. The method of claim 10, wherein the top box secure operation includes, upon detecting a top of the load, temporarily reducing relative rotation speed and tension in a web of packaging material for one or more relative rotations to enable an operator to manually manipulate the web to secure an article on a top layer of the load.

12. The method of claim 1, wherein the controlled wrap cycle interruption includes an add corner boards operation.

13. The method of claim 12, wherein the add corner boards operation includes positioning the packaging material dispenser at a predetermined elevation and temporarily reducing relative rotation speed for a relative rotation to enable an operator to manually insert corner boards along each of a plurality of corners of the load.

14. The method of claim 1, wherein the controlled wrap cycle interruption includes an add top sheet operation.

15. The method of claim 14, wherein the add top sheet operation includes, upon detecting a top of the load, lowering the packaging material dispenser to a predetermined elevation and pausing the wrap cycle to enable an operator to manually place a top sheet over the load, and wherein the add top sheet operation further includes, after restarting of the wrap cycle following placement of the top sheet, performing one or more relative rotations at a reduced relative rotation speed and resuming the wrap cycle.

16. The method of claim 1, wherein the controlled wrap cycle interruption includes a one way wrap operation.

17. The method of claim 16, wherein the one way wrap operation includes, upon detecting a top of the load, stopping the wrap cycle to enable an operator to cut a web of packaging material extending between the packaging material dispenser and the load.

18. The method of claim 1, wherein the controlled wrap cycle interruption includes a stack and wrap operation.

19. The method of claim 18, wherein the stack and wrap operation includes, for each of a plurality of layers of the load:

detecting a top of the load; and in response to detecting the top of the load, pausing the wrap cycle to enable an operator to manually place a next layer on top of the load.

20. The method of claim 18, wherein the stack and wrap operation includes, for each of a plurality of layers of the load:

detecting a top of the load; and in response to detecting the top of the load, pausing the wrap cycle and notifying an external machine to place a next layer on top of the load.

21. The method of claim 1, wherein the controlled wrap cycle interruption includes a band two loads operation.

22. The method of claim 21, wherein the load is a first load, and wherein the band two loads operation includes moving the packaging material dispenser to a predetermined position proximate a top of the first load in response to operator input and wrapping one or more bands of packaging material around the first load and a lower portion of a second load placed on top of the first load to secure the first and second loads to one another.

23. The method of claim 1, further comprising causing a plurality of wrap profile indicators to be displayed on a display, each wrap profile indicator associated with a wrap profile from among the plurality of wrap profiles, wherein receiving the user input selecting the wrap profile includes receiving user input selecting the wrap profile indicator associated with the selected wrap profile.

24. The method of claim 1, wherein each of the plurality of wrap profiles further specifies a minimum number of layers of packaging material and a wrap force to be applied to the load.

25. The method of claim 24, wherein the minimum number of layers and the wrap force specified by each wrap profile are selected to meet a load containment force requirement specified by such wrap profile.

26. The method of claim 25, wherein performing the wrap cycle further includes controlling the load wrapping apparatus to wrap the load using the minimum number of layers and wrap force specified by the selected wrap profile such that the load containment force requirement specified by the selected wrap profile is met when the load is wrapped.

27. The method of claim 26, wherein the load has first and second opposing ends defined along a direction parallel to an axis about which packaging material is wrapped around the load when the load is disposed on the load support, wherein the load wrapping apparatus is further configured for movement of a portion of a web of packaging material relative to the load in the direction parallel to the axis, and wherein controlling the load wrapping apparatus includes, during relative rotation between the packaging material dispenser and the load support:

controlling movement of the web of packaging material in the direction parallel to the axis to apply at least the minimum number of layers of packaging material specified by the selected wrap profile to the load throughout a contiguous region extending between first and second positions respectively disposed proximate the first and second opposing ends of the load; and controlling a dispense rate of the packaging material dispenser based on the wrap force specified by the selected wrap profile.

28. The method of claim 1, wherein the controlled wrap cycle interruption is a first controlled wrap cycle interruption that temporarily pauses or stops relative rotation between the packaging material dispenser and the load support prior to completion of the wrap cycle, wherein the plurality of wrap profiles includes second, third, fourth, fifth, sixth, seventh, eighth, ninth, tenth, eleventh and twelfth wrap profiles, and wherein the method further comprises:

in response to receiving second input data selecting the second wrap profile, performing a second wrap cycle using the second wrap profile, including performing a second controlled wrap cycle interruption during the second wrap cycle that temporarily decreases a relative rotation speed between the packaging material dispenser and the load support prior to completion of the second wrap cycle;

in response to receiving third input data selecting the third wrap profile, performing a third wrap cycle using the third wrap profile, including performing a third controlled wrap cycle interruption during the third wrap cycle that prematurely terminates the third wrap cycle prior to completion of the third wrap cycle;

in response to receiving fourth input data selecting the fourth wrap profile, performing a fourth wrap cycle using the fourth wrap profile, including performing a fourth controlled wrap cycle interruption during the fourth wrap cycle that temporarily changes a dispense rate of the packaging material dispenser prior to completion of the fourth wrap cycle;

in response to receiving fifth input data selecting the fifth wrap profile, performing a fifth wrap cycle using the fifth wrap profile, including performing a fifth controlled wrap cycle interruption during the fifth wrap cycle that prematurely moves the packaging material dispenser to a selected position among a plurality of positions along a direction parallel to an axis about which packaging material is wrapped around the load when the load is disposed on the load support prior to completion of the fifth wrap cycle;

in response to receiving sixth input data selecting the sixth wrap profile, performing a sixth wrap cycle using the sixth wrap profile, including performing a sixth controlled wrap cycle interruption during the sixth wrap cycle that notifies an operator;

in response to receiving seventh input data selecting the seventh wrap profile, performing a seventh wrap cycle using the seventh wrap profile, including performing a seventh controlled wrap cycle interruption during the seventh wrap cycle that includes a top box secure operation;

in response to receiving eighth input data selecting the eighth wrap profile, performing an eighth wrap cycle using the eighth wrap profile, including performing an eighth controlled wrap cycle interruption during the eighth wrap cycle that includes an add corner boards operation;

in response to receiving ninth input data selecting the ninth wrap profile, performing a ninth wrap cycle using the ninth wrap profile, including performing a ninth controlled wrap cycle interruption during the ninth wrap cycle that includes an add top sheet operation;

in response to receiving tenth input data selecting the tenth wrap profile, performing a tenth wrap cycle using the tenth wrap profile, including performing a tenth controlled wrap cycle interruption during the tenth wrap cycle that includes a one way wrap operation;

in response to receiving eleventh input data selecting the eleventh wrap profile, performing an eleventh wrap cycle using the eleventh wrap profile, including performing an eleventh controlled wrap cycle interruption during the eleventh wrap cycle that includes a stack and wrap operation; and in response to receiving twelfth input data selecting the twelfth wrap profile, performing a twelfth wrap cycle using the twelfth wrap profile, including performing a twelfth controlled wrap cycle interruption during the twelfth wrap cycle that includes a band two loads operation.

* * * * *